US007655374B2

(12) United States Patent
Katano et al.

(10) Patent No.: US 7,655,374 B2
(45) Date of Patent: Feb. 2, 2010

(54) FIXING LIQUID, TONER FIXING METHOD AND APPARATUS, AND IMAGE FORMING METHOD AND APPARATUS

(75) Inventors: Yasuo Katano, Kanagawa (JP); Tsuneo Kurotori, Tokyo (JP); Hiromichi Komai, Kanagawa (JP); Takuma Nakamura, Kanagawa (JP); Tomoyasu Hirasawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 11/434,735

(22) Filed: May 17, 2006

(65) Prior Publication Data

US 2006/0263712 A1 Nov. 23, 2006

(30) Foreign Application Priority Data

May 20, 2005 (JP) ..... 2005-148829

(51) Int. Cl.
*G03G 15/20* (2006.01)

(52) U.S. Cl. ..... 430/124.1; 430/124.21; 399/340

(58) Field of Classification Search ..... 430/124.1, 430/124.21; 399/340
See application file for complete search history.

(56) References Cited

U.S. PATENT DOCUMENTS 3,907,695 A * 9/1975 Amidon et al. ..... 430/115
5,476,739 A * 12/1995 Takama et al. ..... 430/47.4
5,666,628 A * 9/1997 Fukai ..... 399/340
2004/0131402 A1 7/2004 Kurotori et al.

FOREIGN PATENT DOCUMENTS

| | | | |
|---|---|---|---|
| EP | 0 636 946 | A1 | 2/1995 |
| EP | 1 653 294 | A2 | 5/2006 |
| JP | 53-118139 | | 10/1978 |
| JP | 59-119364 | | 7/1984 |
| JP | 3290513 | | 3/2002 |
| JP | 2004-109749 | | 4/2004 |
| JP | 2004-109750 | A | 4/2004 |
| JP | 2006-078573 | A | 3/2006 |

OTHER PUBLICATIONS

U.S. Appl. No. 11/734,446, filed Apr. 12, 2007, Katano, et al.
U.S. Appl. No. 11/259,023, filed Oct. 27, 2005, Yasuo Katano, et al.
U.S. Appl. No. 12/132,864, filed Jun. 4, 2008, Nakamura, et al.
U.S. Appl. No. 12/276,528, filed Nov. 24, 2008, Katano, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A fixing liquid configured to fix a toner containing a resin on a recording medium is disclosed, wherein a particle containing a component capable of dissolving or swelling at least one portion of the resin contained in the toner is dispersed in a nonaqueous dispersing medium. A toner fixing method of fixing a toner containing a resin on a recording medium is disclosed, wherein the fixing liquid as described above is used. A toner fixing apparatus configured to fix a toner containing a resin on a recording medium is disclosed, wherein the toner fixing method as described above is used.

14 Claims, 7 Drawing Sheets

FIXING LIQUID, TONER FIXING METHOD AND APPARATUS, AND IMAGE FORMING METHOD AND APPARATUS

BACKGROUND OF THE INVENTION

1. Field of the Invention

The present invention relates to a fixing liquid, a toner fixing method, a toner fixing apparatus, an image forming method, and an image forming apparatus.

2. Description of the Related Art

An image forming apparatus such as a printer, a facsimile machine, and a copying machine is an apparatus for forming an image, which may include a character or a symbol, on a recording medium such as a paper, a cloth, and an OHP sheet based on information of the image. Particularly, an electrophotographic image forming apparatus has been widely used in an office since a high-definition image can be formed on a normal paper with a high speed. In such an electrophotographic image forming apparatus, a heat fixing method has been widely used in which toner is fixed on a recording medium by heating or fusing the toner on the recording medium and pressurizing the fused toner. This heat-fixing method has been preferably used since a high fixing speed, a high fixed image quality, etc., can be provided.

However, approximately half or more of electric power consumed in such an electrophotographic image forming apparatus are consumed for heating toner in the heat fixing method. On the other hand, a fixing apparatus with low electric power consumption (intended for energy conservation) is desired from the viewpoint of recent measures against environmental problems. That is, a fixing method is desired which does not requires to extremely lower temperature at which toner is heated compared to the conventional one or to heat toner, for fixing the toner. Particularly, a no-heat fixing method of fixing toner on a recording medium in which toner is not heated at all is ideal in regard to low electric power consumption.

For such a no-heat fixing method, for example, Japanese Patent No. 3290513 discloses a method for wet-fixing toner which includes spraying or dropping an oil-drop-in-water-type fixing agent onto a surface of an object to be subjected to fixation on which unfixed toner is disposed at a predetermined position, so as to dissolve or swell the toner, in which agent an organic compound is dispersed and mixed in water which compound can dissolve or swell the toner and cannot be dissolved or can be hardly dissolved in water, and subsequently drying the object subjected to fixation.

However, in the wet-fixing method disclosed in Japanese Patent No. 3290513, when a large quantity of the fixing agent is provided to unfixed toner, a recording medium (an object to be subjected to fixation) such as a transcription paper absorbs a water content of the fixing agent and a wrinkle or curl is formed on the recording medium, since the oil-drop-in-water-type fixing agent is used in which agent an organic compound is dispersed and mixed in water which compound can dissolve or swell the toner and cannot be dissolved or can be hardly dissolved in water. Accordingly, stable and high speed conveyance of a recording medium which conveyance is required for an image forming apparatus is markedly interrupted. Then, where a large quantity of water contained in the fixing agent is evaporated using a dryer so as to remove the water content from the fixing agent provided on a the recording medium, an electric power is needed which corresponds to a electric power consumed in an image forming apparatus using the heat-fixing method.

Also, usually, the surface of a toner particle is water-repellently treated with hydrophobic silica, etc., in order to prevent the toner particles from absorbing the water content in atmosphere and aggregating each other and to keep the fluidity of the toner. Therefore, when an aqueous fixing liquid containing water as a dispersion medium, such as the aforementioned fixing agent, is sprayed or dropped onto unfixed toner on a recording medium, the water-repellently treated toner particles are repelled by the aqueous fixing liquid. As a result, a blank portion is formed on a toner image and a defect is produced on the image.

FIGS. 1A, 1B, and 1C are diagrams illustrating a fixing method of providing an aqueous fixing liquid to water-repellently treated toner on a recording medium. As shown in FIG. 1A, a liquid drop of an aqueous fixing liquid 13 is dropped onto a layer of water-repellently treated unfixed toner 12 transcribed on a recording paper 11 as a recording medium by a proper fixing liquid providing device. At this time, as shown in FIG. 1B, when the liquid drop of an aqueous fixing liquid 13 contacts the layer of water-repellently treated unfixed toner 12, particles of water-repellently treated unfixed toner 12 are repelled by the liquid drop of an aqueous fixing liquid 13. Consequently, as shown in FIG. 1C, the particles of water-repellently treated unfixed toner 12 which have been repelled by the liquid drop of an aqueous fixing liquid 13 are transferred to a peripheral portion of the liquid drop of an aqueous fixing liquid 13 with the diffusion of the aqueous fixing liquid 13 on and in the recording paper 11. Then, an undesired blank portion of the water-repellently treated toner is formed on the layer of water-repellently treated unfixed toner 12 transcribed on the recording paper 11 and a defect is produced on an image formed by the toner. Thus, when the aqueous fixing liquid 13 is used, there is a problem that the layer of unfixed toner 12 transcribed on the recording paper 11 is easily disturbed.

On the other hand, for a fixing liquid which does not repel water-repellently treated unfixed toner, a nonaqueous fixing liquid is disclosed in which a material capable of dissolving or swelling toner is dissolved in a nonaqueous solvent. For example, Japanese Laid-Open Patent Application No. 2004-109749 discloses a fixing liquid in which an ester from an aliphatic dibasic acid, etc., as a material component capable of dissolving or swelling a resin component constituting toner, is diluted with (or dissolved in) nonvolatile dimethyl silicone as a diluent (or solvent). Also, for a fixing solution which can be used in a fixation method that an unfixed image formed by an electrostatic method can be sharply or easily fixed on an image receiving sheet without disturbing an image, Japanese Laid-Open Patent Application No. 59-119364 discloses a solution for fixing an unfixed toner image, which can dissolve toner and is obtained by mixing 8-120 parts by volume of a silicone oil into 100 parts by volume of a solvent having a compatibility with the silicone oil on a mutual dissolution condition. Since such a nonaqueous fixing liquid contains a nonaqueous solvent having a high affinity with water-repellently treated unfixed toner, the toner can be dissolved or swelled and fixed on a recording medium without repelling the water-repellently unfixed toner.

Herein, the use of a VOC (volatile organic compound) as a nonaqueous solvent used for a nonaqueous fixing liquid has an adverse affect on a human body, causes the generation of unpleasant odor and, therefore, is not preferable. Consequently, a nonvolatile nonaqueous solvent is practically used as a nonaqueous solvent used in a nonaqueous fixing liquid.

However, a nonaqueous fixing liquid in which a material capable of dissolving or swelling toner is dissolved in a nonvolatile nonaqueous solvent has a high permeability into a recording medium. Therefore, when a nonaqueous fixing liquid as described above is sprayed or dropped onto unfixed toner on a recording medium, the nonaqueous fixing liquid has a high speed for diffusing on or in the recording medium and penetrating through the recording medium and only a portion of the material capable of dissolving or swelling toner contained in the nonaqueous fixing liquid dissolves or swells the unfixed toner on the recording medium. Then, the residual portion of the material capable of dissolving or swelling toner is not utilized for dissolving or swelling the toner and diffuses on or in the recording medium and penetrates through the recording medium with the nonaqueous solvent. Thus, since only a portion of the material capable of dissolving or swelling toner contained in the nonaqueous fixing liquid dissolves or swells the unfixed toner on the recording medium, it is necessary to increase the concentration of the material capable of dissolving or swelling toner contained in the nonaqueous fixing liquid. For example, the inventors have found that the concentration of a solvent dissolved into a silicone oil as a nonaqueous solvent for the fixing solution disclosed in Japanese Laid-Open Patent Application No. 59-119364 is necessarily 20% by weight or greater. Therefore, in regard to a nonaqueous fixing liquid in which a material capable of dissolving or swelling toner is dissolved in a nonvolatile nonaqueous solvent, the efficiency of dissolving or swelling the toner with the material capable of dissolving or swelling toner is low.

FIGS. 2A, 2B and 2C are diagrams illustrating a fixing method in which a nonaqueous fixing liquid is provided to water-repellently treated toner on a recording medium in which liquid a material capable of dissolving or swelling toner is dissolved in a nonvolatile nonaqueous solvent. As shown in FIG. 2A, a liquid drop of a nonaqueous fixing liquid 23 in which a material capable of dissolving or swelling toner is dissolved in a nonvolatile nonaqueous solvent is dropped onto a layer of water-repellently treated unfixed toner 22 transcribed on a recording paper 21 as a recording medium by a proper fixing liquid providing device. At this time, as shown in FIG. 2B, the nonaqueous fixing liquid 23 contacting the recording paper 21 has a high permeability into the recording paper 21 and rapidly permeates into the recording paper 21. As a result, as shown in FIG. 2C, only a portion of the material capable of dissolving or swelling toner contained in the nonaqueous fixing liquid 23 can dissolve or swell the unfixed toner 22 on the recording paper 21 but the residual portion of the material capable of dissolving or swelling toner permeates and diffuses in the recording paper 21 with the nonvolatile nonaqueous solvent without dissolving or swelling the unfixed toner 22 on the recording paper 21. Thus, when a nonaqueous fixing liquid in which a material capable of dissolving or swelling toner is dissolved in a nonvolatile nonaqueous solvent is used, there is a problem that the utilization efficiency of the material capable of dissolving or swelling toner is low.

Consequently, a fixing liquid capable of fixing toner on a recording medium more efficiently has been desired.

SUMMARY OF THE INVENTION

According to the first aspect of the present invention, there can be provided a fixing liquid configured to fix a toner containing a resin on a recording medium, wherein a particle containing a component capable of dissolving or swelling at least one portion of the resin contained in the toner is dispersed in a nonaqueous dispersing medium.

According to the second aspect of the present invention, there can be provided a toner fixing method of fixing a toner containing a resin on a recording medium, wherein the fixing liquid as described above is used.

According to the third aspect of the present invention, there can be provided a toner fixing method of fixing a toner containing a resin on a recording medium, wherein a fixing liquid containing a component capable of dissolving or swelling at least one portion of the resin contained in the toner is used in which liquid a particle having a particle diameter such that the particle does not penetrate through the recording medium is dispersed in a nonaqueous dispersing medium.

According to the fourth aspect of the present invention, there can be provided a toner fixing apparatus configured to fix a toner containing a resin on a recording medium, wherein the toner fixing method as described above is used.

According to the fifth aspect of the present invention, there can be provided an image forming method of forming an image of toner containing a resin on a recording medium, wherein the toner fixing method as described above is used.

According to the sixth aspect of the present invention, there can be provided an image forming apparatus configured to form an image of toner containing a resin on a recording medium, wherein the image forming method as described above is used.

DETAILED DESCRIPTION OF THE PREFERRED EMBODIMENTS

Figure 1A:
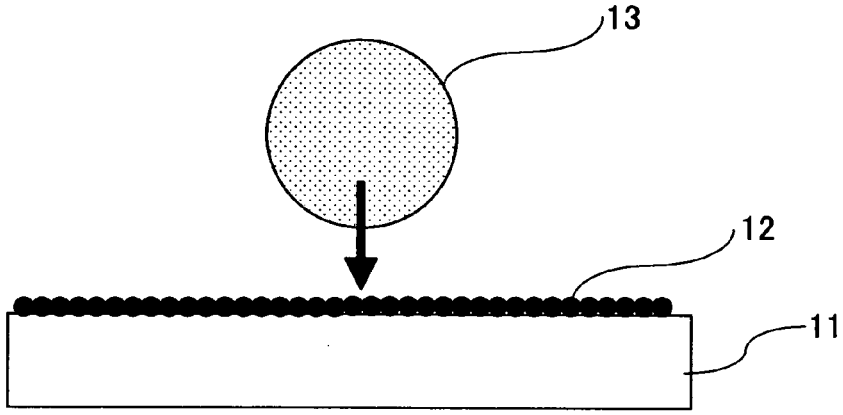
FIGS. 1A, 1B, and 1C are diagrams illustrating a fixing method of providing an aqueous fixing liquid to water-repellently treated toner on a recording medium.
Figure 1B:
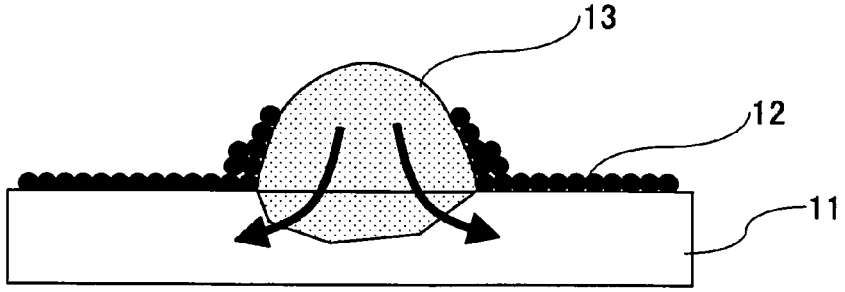
Figure 1C:
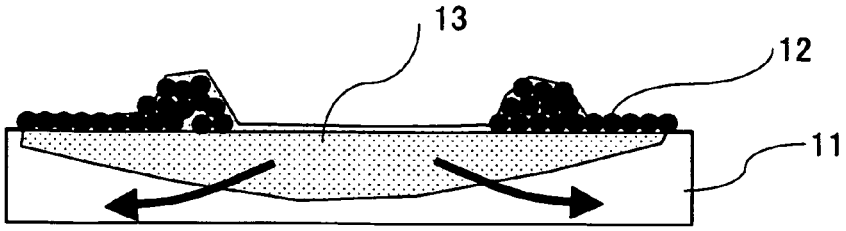
Figure 2A:
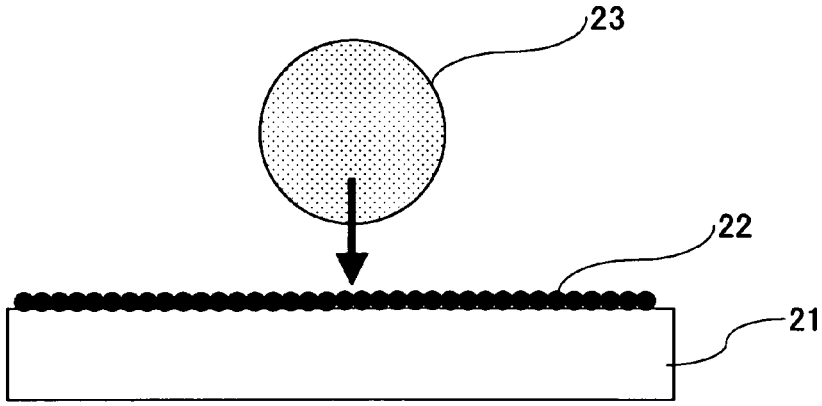
FIGS. 2A, 2B, and 2C are diagrams illustrating a fixing method of providing a nonaqueous fixing liquid to water-repellently treated toner on a recording medium in which a material capable of dissolving or swelling toner is dissolved in a nonvolatile nonaqueous solvent.
Figure 2B:
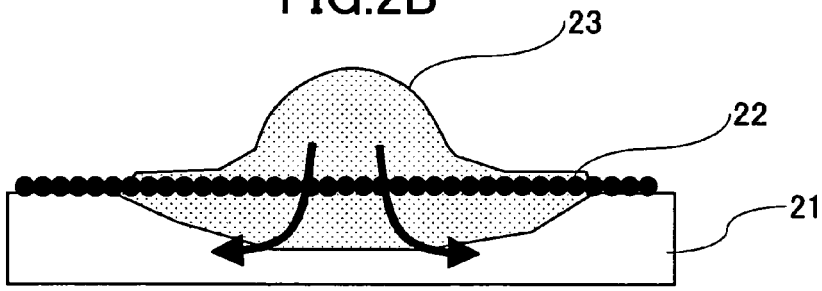
Figure 2C:
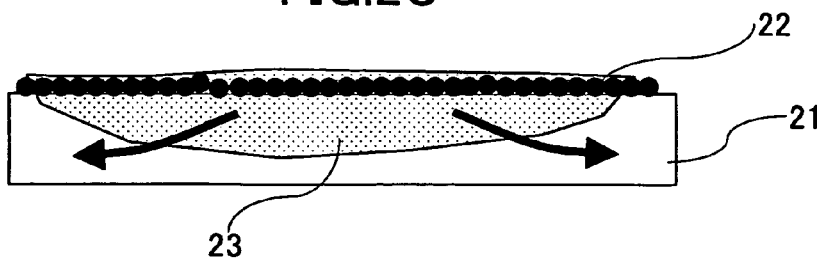

Next, embodiments of the present invention are described with reference to the drawings.

The first embodiment of the present invention is a fixing liquid configured to fix a toner containing a resin on a recording medium, wherein a particle containing a component (material A) capable of dissolving or swelling at least one portion of the resin contained in the toner is dispersed in a nonaqueous dispersing medium (material B).

The toner contains a resin such as a binder resin and a releasing agent. The resin contained in the toner is not particularly limited but, for a preferable binder resin, a polystyrene resin, a styrene-acryl copolymer resin, a polyester resin, etc., can be provided and, for a releasing agent, for example, a wax component such as polyethylene can be provided. The toner may contain a well-known coloring agent, charge control agent, fluidizing agent, external additive, etc., as well as the binder resin. Also, it is preferable that the toner is water-repellently treated by fixing a hydrophobic fine particle such as a hydrophobic silica having a methyl group and a hydrophobic titanium oxide on the surface of the toner particle.

The recording medium is not particularly limited and, for example, a paper, a cloth, a plastic film such as an OHP sheet having a liquid penetrating layer, etc., can be provided.

The component (material A) capable of dissolving or swelling at least one portion of the resin contained in the toner is not limited if it can dissolve or swell at least one portion of the resin contained in the toner so as to fix the toner on a recording medium.

The particle containing the component (material A) capable of dissolving or swelling at least one portion of the resin contained in the toner may be a liquid particle, a liquid gel particle, or a particle of semi-solid such as a wax. When the particle containing the component (material A) capable of dissolving or swelling at least one portion of the resin contained in the toner is liquid, its viscosity is preferably 1 mPa·second or greater and 100 Pa·second or less.

The nonaqueous dispersing medium (material B) is a dispersing medium of liquid in which the particle containing the component (material A) capable of dissolving or swelling at least one portion of the resin contained in the toner is dispersed. Herein, "nonaqueous" means that the solubility thereof in water at room temperature (20° C.) is 0.1% by weight or less. Preferably, the nonaqueous dispersing medium (material B) has a sufficient affinity with a particle of water-repellently treated toner. Herein, the "affinity" means the degree of extensional wetting of liquid on the surface of a solid when the liquid contacts the solid. That is, it is preferable that the nonaqueous dispersing medium (material B) indicates a sufficient wettability to a water-repellently treated toner. The surface of the toner that have been water-repellently treated with a hydrophobic fine particle such as a hydrophobic silica particle and a hydrophobic titanium oxide particle is covered with a methyl group of the hydrophobic silica particle or the hydrophobic titanium oxide particle and has a surface energy of approximately 20 mN/m. Since the whole surface of the water-repellently treated toner is not completely covered with a hydrophobic fine particle, the surface energy of the water-repellently treated toner is guessed to be approximately 20 mN/m through 30 mN/m. Therefore, in order to have an affinity (have a sufficient wettability) with the water-repellent toner, it is preferable that the surface tension of the nonaqueous dispersing medium (material B) is 20 mN/m through 30 mN/m. For such a nonaqueous dispersing medium (material B), for example, a fluorine-containing oil, a paraffinic oil, an olefinic oil, a silicone-based oil, etc., can be provided.

The particle containing the component (material A) capable of dissolving or swelling at least one portion of the resin contained in the toner is not dissolved in a nonaqueous solvent but is dispersed in the nonaqueous dispersing medium (material B). A dispersing agent may be used for dispersing the particle containing the component (material A) in the nonaqueous dispersing medium (material B). In order to stably disperse in the nonaqueous dispersing medium (material B) the particle containing the component (material A) capable of dissolving or swelling at least one portion of the resin contained in the toner, it is preferable that the dispersing agent is a surface active agent with a HLB (hydrophile-lipophile balance) value of 5 or less. Herein, the HLB value may be, for example, a value calculated in accordance with HLB value=20×(the molecular weight of a hydrophilic group of a surface active agent)/(the molecular weight of the surface active agent), which is known as Griffin formula.

As a method for dispersing in the nonaqueous dispersing medium (material B) the particle containing the component (material A) capable of dissolving or swelling at least one portion of the resin contained in the toner, a material containing the component (material A) is mixed into the nonaqueous dispersing medium (material B) and the obtained mixture is mechanically stirred or vibration is applied to the obtained mixture. Thus, a fixing liquid according to the first embodiment of the present invention can be obtained. For example, a mechanically stirring device such as homomixer and homogenizer and a vibrating device such as an ultrasonic homogenizer can be provided. Additionally, it is desirable that a weakly stirring device such as a homomixer is used in order to make the particle diameter of a particle containing the component (material A) capable of dissolving or swelling at least one portion of the resin contained in the toner be 0.1 μm or greater and 6 μm or less.

According to the first embodiment of the present invention, a fixing liquid capable of fixing toner on a recording medium more efficiently can be provided.

For example, since a nonaqueous medium is used for the fixing liquid according to the first embodiment of the present invention, a defect on an image formed by toner provided on a recording medium can be reduced which defect can be produced at the time of providing the fixing liquid to the toner provided on the recording medium.

Also, for example, in the fixing liquid according to the first embodiment of the present invention, the component (material A) capable of dissolving or swelling at least one portion of the resin contained in the toner is not dissolved in a nonaqueous solvent but the particle containing the component (material A) is dispersed in the nonaqueous dispersing medium (material B). Therefore, the probability becomes higher that the particle containing the component (material A) capable of dissolving or swelling at least one portion of the resin contained in the toner does not permeate into a recording medium nor penetrate through the recording medium but contacts the toner provided on the recording medium while the nonaqueous dispersing medium (material B) permeates into a recording medium or penetrates through the recording medium. In this case, since the probability becomes higher that the component (material A) contained in the particle does not permeate into the recording medium nor penetrate through the recording medium but acts on the toner provided on the recording medium, the component (material A) can be effectively acted on the toner provided on the recording medium. Accordingly, the toner provided on the recording medium can be fixed more speedily and, as a result, the fixation responsibility of the toner provided on the recording medium can be improved. Also, the quantity of the component (material A) capable of dissolving or swelling at least one portion of the resin contained in the toner can be reduced. Further, the waste with respect to the consumption of the component (material A) capable of dissolving or swelling at least one portion of the resin contained in the toner can be reduced.

In the fixing liquid according to the first embodiment of the present invention, preferably, the particle is liquid. When the component (material A) capable of dissolving or swelling at least one portion of the resin contained in the toner is a liquid particle, the fixing liquid is an emulsion in which the liquid particle is dispersed in the nonaqueous dispersing medium (material B). In this case, since the component (material A) capable of dissolving or swelling at least one portion of the resin contained in the toner is a liquid particle, the liquid particle containing the component (material A) acts the toner provided on the recording medium more easily and the toner provided on the recording medium can be fixed more speedily.

In the fixing liquid according to the first embodiment of the present invention, preferably, the particle is composed of a single phase containing the component (material A) capable of dissolving or swelling at least one portion of the resin contained in the toner.

When the particle is composed of a single phase containing the component (material A) capable of dissolving or swelling at least one portion of the resin contained in the toner and the particle containing the component (material A) is liquid and aqueous, the fixing liquid is a water-in-oil (W/O) emulsion in which an aqueous particle is dispersed in the nonaqueous dispersing medium (material B). Also, when the article containing the component (material A) is liquid and nonaqueous, the fixing liquid is an oil-in-oil (O/O) emulsion in which a nonaqueous particle is dispersed in the nonaqueous dispersing medium (material B). Both the W/O emulsion and the O/O emulsion are allowed in the present invention.

The particle composed of a single phase containing the component (material A) capable of dissolving or swelling at least one portion of the resin contained in the toner may be, for example, a particle composed of the component (material A), which particle is insoluble in the nonaqueous dispersing medium (material B). In this case, the component (material A) is usually soluble in water.

When the particle is composed of a single phase containing the component (material A) capable of dissolving or swelling at least one portion of the resin contained in the toner and the component (material A) is a material that is insoluble in a nonaqueous medium, the particle containing the component (material A) can be stably dispersed in the nonaqueous medium (material B).

Figure 3:
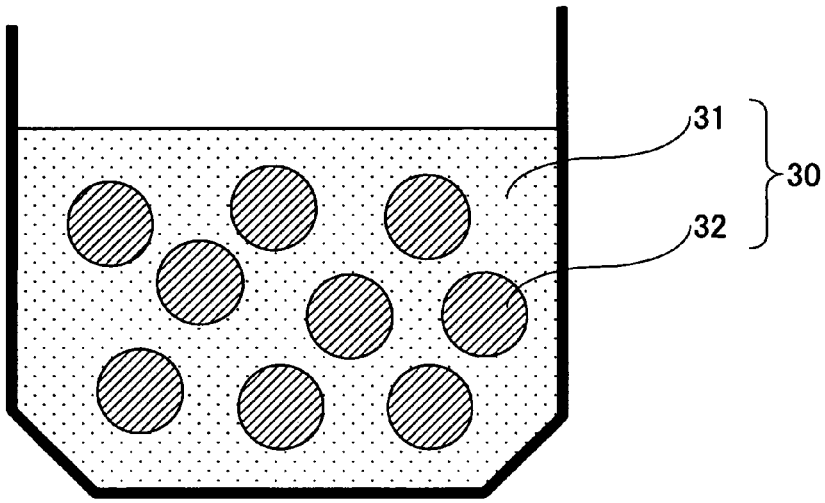
FIG. 3 is a diagram illustrating one example of a fixing liquid according to the present invention.

FIG. 3 is a diagram illustrating one example of a fixing liquid according to the present invention. A fixing liquid 30 shown in FIG. 3 contains a nonaqueous dispersing medium (material B) 31 and particles 32 which is insoluble in the nonaqueous dispersing medium (material B) 31 and are composed of a single phase containing a component (material A) capable of dissolving or swelling at least one portion of a resin contained in toner. In the fixing liquid 30, the particles 32 are dispersed in the nonaqueous dispersing medium (material B) 31. The particles 32 are composed of only the component (material A) capable of dissolving or swelling at least one portion of the resin contained in the toner. The nonaqueous dispersing medium (material B) 31 may be, for example, an n-alkane, dimethyl silicone, or an α-olefinic solvent, and the component (material A) capable of dissolving or swelling at least one portion of the resin contained in the toner may be, for example, an aliphatic ester which is insoluble in the nonaqueous dispersing medium (material B) 31. Also, the fixing liquid 30 may contain a dispersing agent, such as a surface active agent, which stably disperses the particles 32 in the nonaqueous dispersing medium (material B) 31.

In the fixing liquid according to the first embodiment of the present invention, preferably, the particle contains the component (material A) capable of dissolving or swelling at least one portion of a resin contained in toner and a solvent or dispersing medium (material C) for dissolving or dispersing the component (material A).

The particle containing the component (material A) capable of dissolving or swelling at least one portion of a resin contained in toner and the solvent or dispersing medium (material C) for dissolving or dispersing the component (material A) may be, for example, a particle containing the component (material A) and a solvent for dissolving the component (material A) or a particle containing the component (material A) and a dispersing medium for dispersing the component (material A).

Additionally, the solvent or dispersing medium (material C) for dissolving or dispersing the component (material A) is a liquid which is insoluble in the nonaqueous dispersing medium (material B). Herein, the liquid which is insoluble in the nonaqueous dispersing medium (material B) is a liquid of which the solubility in a nonaqueous medium at room temperature (20° C.) is 0.1% by weight or less.

Also, the component (material A) capable of dissolving or swelling at least one portion of a resin contained in toner may be a material which is soluble in the nonaqueous dispersing medium (material B) or a material which is insoluble in the nonaqueous dispersing medium (material B).

That is, when the particle contains the component (material A) capable of dissolving or swelling at least one portion of a resin contained in toner and the solvent or dispersing medium (material C) for dissolving or dispersing the component (material A), the particle containing the component (material A) capable of dissolving or swelling at least one portion of a resin contained in toner can be stably dispersed in the nonaqueous dispersing medium (material B) even if the component (material A) is either of the material which is soluble in a nonaqueous medium or the material which is insoluble in a nonaqueous medium.

Herein, when the particle is a particle containing the component (material A) capable of dissolving or swelling at least one portion of a resin contained in toner and a solvent which dissolves the component (material A), the concentration of the component (material A) can be adjusted by a solvent for dissolving a component capable of dissolving at least one portion of a resin contained in toner and, therefore, the dissolution or swelling of at least one portion of the resin contained in the toner can be controlled in more detail. Also, in this case, the component (material A) capable of dissolving or swelling at least one portion of a resin contained in toner is usually aqueous, and the fixing liquid is an water-in-oil (W/O) emulsion in which an aqueous particle is dispersed in the nonaqueous dispersing medium (material B).

Also, the particle contains the component (material A) can be adjusted by a solvent for dissolving a component capable of dissolving at least one portion of a resin contained in toner and a dispersing medium for dispersing the component (material A), the component (material A) is usually insoluble in the dispersing medium for dispersing the component (material A), and is dispersed in such a dispersing medium using a dispersing agent such as a surface active agent. In this case, usually, the component (material A) can be adjusted by a solvent for dissolving a component capable of dissolving at least one portion of a resin contained in toner is nonaqueous and the dispersing medium for dispersing the component (material A) is aqueous. Then, the fixing liquid is an oil/water/oil (O/W/O) type emulsion in which an aqueous particle is dispersed in the nonaqueous medium (material B) and, in the aqueous particle, the component (material A) capable of dissolving or swelling at least one portion of a resin contained in a nonaqueous toner is dispersed in an aqueous dispersing medium.

Figure 4:
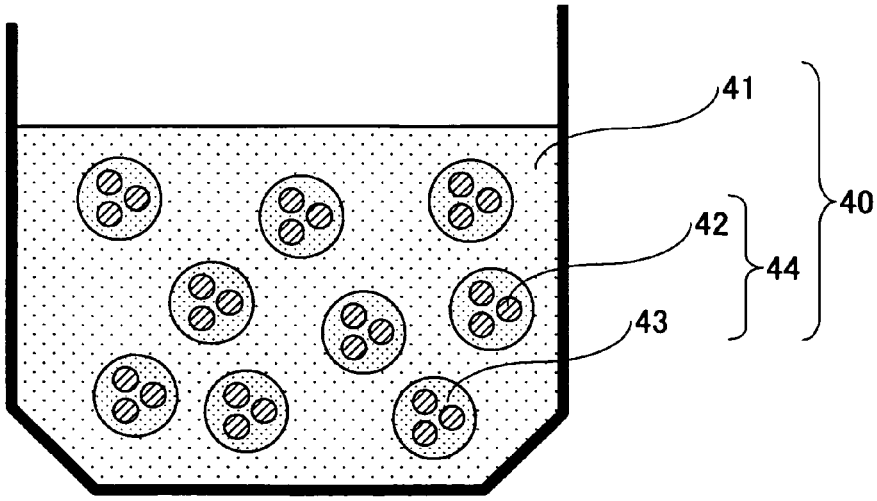
FIG. 4 is a diagram illustrating another example of a fixing liquid according to the present invention.

FIG. 4 is a diagram illustrating another example of a fixing liquid according to the present invention. A fixing liquid 40 shown in FIG. 4 contains a nonaqueous dispersing medium (material B) 41 and particles 44 containing a component 42 (material A) capable of dissolving or swelling at least one portion of a resin contained in toner and a solvent or dispersing medium (material C) 43 for dissolving or dispersing the component (material A). in the fixing liquid 40, the solvent or dispersing medium (material C) 43 for dissolving or dispersing the component 42 (material A) capable of dissolving or swelling at least one portion of the resin contained in the toner is insoluble in the nonaqueous dispersing medium (material B) 41. Then, the particles 44 containing the component (material A) 42 and the solvent or dispersing medium (material C) 43 for dissolving or dispersing the component (material A) capable of dissolving or swelling at least one portion of the resin contained in the toner are dispersed in the nonaqueous dispersing medium (material B) 41. The particle 44 may be composed of the component 42 (material A) capable of dissolving or swelling at least one portion of the resin contained in the toner and a solvent 43 for dissolving the component (material A) capable of dissolving or swelling at least one portion of the resin contained in the toner, or may be composed of the component 42 (material A) capable of dissolving or swelling at least one portion of the resin contained in the toner and a dispersing medium 43 for dispersing the component (material A) capable of dissolving or swelling at least one portion of the resin contained in the toner. The nonaqueous dispersing medium (material B) 41 may be, for example, an n-alkane, dimethyl silicone, or α-olefinic solvent. Also, the component 42 (material A) capable of dissolving or swelling at least one portion of the resin contained in the toner may be, for example, either an aliphatic ester which is soluble in the dispersing medium (material B) 41 or an aliphatic ester which is insoluble in the dispersing medium (material B) 41. Further, the solvent or dispersing medium (material C) 43 for dissolving or dispersing the component (material A) capable of dissolving or swelling at least one portion of the resin contained in the toner, which solvent or dispersing medium is insoluble in the dispersing medium (material B) 41, may be water. Also, the fixing liquid 40 may contain a dispersing agent, such as a surface active agent, for stably dispersing the particles 44 in the nonaqueous dispersing medium (material B) 41. Then, the particle 44 may contain a dispersing agent, such as a surface active agent, in order to stably disperse the component (material A) 42 capable of dissolving or swelling at least one portion of the resin contained in the toner, in the solvent or dispersing medium (material C) 43 for dissolving or dispersing the component (material A) capable of dissolving or swelling at least one portion of the resin contained in the toner.

In the fixing liquid according to the first embodiment of the present invention, preferably, the volume average particle diameter of the particle is 0.3 μm or greater. When the volume average particle diameter of the particle containing the component (material A) capable of dissolving or swelling at least one portion of the resin contained in the toner is 0.3 μm or greater, the probability becomes higher that while when the fixing liquid according to the first embodiment of the present invention is provided to a recording medium on which the toner has been provided the nonaqueous dispersing medium (material B) permeates into the recording medium or penetrates through the recording medium, the particle containing the component (material A) capable of dissolving or swelling at least one portion of the resin contained in the toner does not pass among the toner particles provided on the recording medium nor permeate into the recording medium nor penetrate through the recording medium but adheres to the toner particle provided on the recording medium or adheres to the surface of the recording medium. As a result, since the probability becomes higher that the component (material A) capable of dissolving or swelling at least one portion of the resin contained in the toner acts on the toner provided on the recording medium, the component (material A) capable of dissolving or swelling at least one portion of the resin contained in the toner can be acted on the toner provided on the recording medium more efficiently. Accordingly, the toner provided on the recording medium can be fixed more speedily and, as a result, the fixation responsibility of the toner provided on the recording medium can be improved. Also, the quantity of the component capable of dissolving or swelling at least one portion of the resin contained in the toner can be more reduced. Further, the waste with respect to the consumption of the component (material A) capable of dissolving or swelling at least one portion of the resin contained in the toner can be more reduced.

The reason why such a particle containing the component (material A) capable of dissolving or swelling at least one portion of the resin contained in the toner does not pass among the toner particles provided on the recording medium is that while the toner is usually water-repellently treated, the particle containing the component (material A) capable of dissolving or swelling at least one portion of the resin contained in the toner which particle is dispersed in the nonaqueous dispersing medium (material B) of the fixing liquid is usually aqueous and has surface tension of 30 mN/m and the particle is repelled by the water-repellently treated toner and the particle diameter of the particle is greater than the space among the toner particles provided on the recording medium.

On the other hand, when the volume average particle diameter of the particle containing the component (material A) capable of dissolving or swelling at least one portion of the resin contained in the toner is less than 0.3 μm and the fixing liquid according to the first embodiment of the present invention is provided to a recording medium on which the toner is provided, the probability becomes higher that the particle containing the component (material A) capable of dissolving or swelling at least one portion of the resin contained in the toner pass among the toner particles provided on the recording medium, permeates into the recoding medium or penetrates through the recording medium, with the nonaqueous dispersing medium (material B) of the fixing liquid.

As a result, the probability becomes lower that the component (material A) acts on the toner provided on the recording medium and the component (material A) may not be able to sufficiently act on the toner provided on the recording medium. Accordingly, the toner provided on the recording medium may not be able to be sufficiently fixed speedily, and, consequently, the fixation responsibility of the toner provided on the recording medium may not be able to be so improved. Also, the quantity of the component (material A) capable of dissolving or swelling at least one portion of the resin contained in the toner may not be able to be sufficiently reduced and a art of the component (material A) may be able to be wasted.

Herein, the volume average particle diameter of the particle containing the component (material A) capable of dissolving or swelling at least one portion of the resin contained in the toner can be measured by, for example, laser light diffraction and scattering method (For example, the measurement at a wavelength of 780 nm and temperature at 25° C. in an apparatus of Microtrac Inc.).

In the fixing liquid according to the first embodiment of the present invention, preferably, the volume average particle diameter of the particle is 6 μm or less.

When the volume average particle diameter of the particle containing the component (material A) capable of dissolving or swelling at least one portion of the resin contained in the toner is 6 μm or less and the fixing liquid according to the first embodiment of the present invention is provided to a recording medium on which the toner is provided, the toner provided on the recording medium does not too be dissolved or swelled and disturbance on an image formed by the toner provided on the recording medium can be reduced.

On the contrary, when the volume average particle diameter of the particle containing the component (material A) capable of dissolving or swelling at least one portion of the resin contained in the toner is greater than 6μ and the fixing liquid according to the first embodiment of the present invention is provided to a recording medium on which the toner is provided, the toner provided on the recording medium may be too dissolved or swelled and liquefied toner may permeate into the recording medium, so that disturbance (bleeding) of an image formed by the toner provided on the recording medium may be caused.

Also, it is preferable that the volume average particle diameter of the particle is smaller than the volume average particle diameter of the toner particle provided on the recording medium. When the volume average particle diameter of the particle containing the component (material A) capable of dissolving or swelling at least one portion of the resin contained in the toner is larger than the volume average particle diameter of the toner particle, there is a possibility that the component (material A) capable of dissolving or swelling at least one portion of the resin contained in the toner is not uniformly provided to the toner particle provided on the recording medium.

The volume average particle diameter of the toner particle can be obtained, for example, by irradiating a plurality of toner particles on the recording medium with laser and from the wavelength of the laser light and the average value of diffraction angle of laser light diffracted by the toner particles.

In the fixing liquid according to the first embodiment of the present invention, preferably, the content of the particle contained in the nonaqueous dispersing medium (material B) is 0.5% by weight or greater and 50% by weight or less. More preferably, the content of the particle contained in the nonaqueous dispersing medium (material B) is 1% by weight or greater and 10% by weight or less.

When the content of the particle contained in the nonaqueous dispersing medium (material B) is less than 0.5% by weight, at least one portion of the resin contained in the toner may not be able to be sufficiently dissolved or swelled and there is a possibility that the toner may not be able to be sufficiently fixed on the recording medium. Also, when the content of the particle contained in the nonaqueous dispersing medium (material B) is greater than 50% by weight, at least one portion of the resin contained in the toner may be too dissolved or swelled and the fluidity of the toner may not be able to be lowered over a prolonged period of time. Therefore, there is a possibility that a layer of the toner to which the fixing liquid is provided has stickiness.

Thus, when the content of the particle contained in the nonaqueous dispersing medium (material B) is 0.5% by weight or greater and 50% by weight or less, at least one portion of the resin contained in the toner can be moderately dissolved or swelled and the toner can be fixed on the recording medium well.

In the fixing liquid according to the first embodiment of the present invention, preferably, the component (material A) capable of dissolving or swelling at least one portion of the resin contained in the toner includes an aliphatic ester.

It is preferable that the component (material A) capable of dissolving or swelling at least one portion of the resin contained in the toner includes an aliphatic ester since the aliphatic ester is excellent in the dissolution property or swelling property thereof for dissolving or swelling at least one portion of the resin contained in the toner.

Also, in regard to the component (material A) capable of dissolving or swelling at least one portion of the resin contained in the toner, it is preferable that the acute oral toxicity $LD_{50}$ thereof is greater than 3 g/kg, from the viewpoint of safety for a human body. The safety of the aliphatic ester to a human body is high so that it is frequently used as a raw material for a cosmetic.

Further, since the fixation of toner onto a recording medium is conducted in an instrument which is frequently used in a closed environment and the component (material A) capable of dissolving or swelling at least one portion of the resin contained in the toner remains in the toner even after the fixation of the toner on the recording medium, it is preferable that the fixation of the toner onto the recording medium involves no generation of a volatile organic compound (VOC) or unpleasant odor. That is, it is preferable that the component (material A) capable of dissolving or swelling at least one portion of the resin contained in the toner contains no volatile organic compound (VOC) or no material which causes the generation of unpleasant odor. The aliphatic ester has a high boiling point and a low volatility and has no irritating odor, compared to a commonly used organic solvent (toluene, xylene, methyl ethyl ketone, etc.). Also, the aliphatic ester has an advantage of causing no contamination of water quality.

Herein, as a practical measure for odor measurement which can measure odor in an office environment, etc., with a high precision, an odor intensity index (10×log(dilute strength of a substance at which the odor of the material cannot be sensed)) from a triangle odor bag method that is a sensory measurement can be an index of odor intensity.

It is preferable that the odor intensity index of the aliphatic ester contained in the component (material A) capable of dissolving or swelling at least one portion of the resin contained in the toner is 10 or less. In this case, unpleasant odor is not sensed in a usual office environment.

Additionally, it is preferable that not only the component (material A) capable of dissolving or swelling at least one portion of the resin contained in the toner but also a material such as the nonaqueous dispersing medium (material B) contained in the fixing liquid has no unpleasant odor or irritating odor. Further, since the content of the nonaqueous dispersing medium (material B) in the fixing liquid is high, the odor intensity index of the nonaqueous dispersing medium (material B) is preferably 7 or less, more preferably, 3 or less.

In the fixing liquid according to the first embodiment of the present invention, preferably, the aliphatic ester includes a saturated aliphatic ester.

When the aliphatic ester includes a saturated aliphatic ester, the preservation stability (the resistance to oxidation, hydrolysis, etc.) of the component (material A) capable of dissolving or swelling at least one portion of the resin contained in the toner can be improved. Also, the safety of the saturated aliphatic ester to a human body is high and many of the saturated aliphatic esters can dissolve or swell the resin contained in the toner within one second. Further, after the nonaqueous dispersing medium (material B) evaporates from the recording medium, the saturated aliphatic ester can reduce the stickiness of the toner provided on the recording medium. This is because the saturated aliphatic ester forms an oil film on the surface of the dissolved or swelled toner.

In the fixing liquid according to the first embodiment of the present invention, preferably the saturated aliphatic ester includes a compound represented by a general formula, $$R_1COOR_2,$$

in which $R_1$ is an alkyl group with a carbon number of 11 or greater and 14 or less and $R_2$ is an alkyl group with a carbon number of 1 or greater and 3 or less.

When the saturated aliphatic ester includes a compound represented by a general formula, $R_1COOR_2$, in which $R_1$ is an alkyl group with a carbon number of 11 or greater and 14 or less and $R_2$ is an alkyl group with a carbon number of 1 or greater and 3 or less, the dissolution property or swelling property thereof for the resin contained in the toner can be improved. Also, the odor intensity index of the aforementioned compound is 10 or less and the aforementioned compound has no unpleasant odor or irritating odor.

For an aliphatic monocarboxylate ester which is the aforementioned compound, for example, ethyl laurate, hexyl laurate, ethyl tridecylate, isopropyl tridecylate, ethyl myristate, isopropyl myristate, etc., can be provided. Many of these aliphatic monocarboxylate esters which are the aforementioned compound dissolve in the nonaqueous dispersing medium (material B) but do not dissolve in water. Therefore, in regard to many of the aliphatic monocarboxylate esters which are the aforementioned compounds, for example, the fixing liquid according to the first embodiment of the present invention can be obtained by dispersing the aliphatic monocarboxylate ester which is the aforementioned compound in water so as to prepare an aqueous dispersion system and by dispersing the aqueous dispersion system as a particle in a nonaqueous medium. That is, as shown in FIG. 4, a fixing liquid can be obtained in which liquid an aqueous particle is dispersed in the nonaqueous dispersing medium (material B) in which particle the aliphatic monocarboxylate ester as the component (material A) capable of dissolving or swelling at least one portion of the resin contained in the toner is dispersed in water.

In the fixing liquid according to the first embodiment of the present invention, preferably, the aliphatic ester includes an aliphatic dicarboxylate ester.

When the aliphatic ester includes an aliphatic dicarboxylate ester, the resin contained in the toner can be dissolved or swelled for a shorter time period. For example, at a high speed character printing of approximately 600 ppm, it is desirable that a time period in which a fixing liquid is provided to unfixed toner on a recording medium and the toner fixes on the recording medium is within 1 second. When the aliphatic ester includes an aliphatic dicarboxylate ester, a time period required for providing a fixing liquid to unfixed toner on a recording medium and fixing the toner on the recording medium can be within 1 second. Further, since the resin contained in the toner can be dissolved or swelled by addition of a smaller quantity of the component (material A) capable of dissolving or swelling at least one portion of the resin contained in the toner, the content of the component (material A) capable of dissolving or swelling at least one portion of the resin contained in the toner, which component in the fixing liquid, can be reduced.

In the fixing liquid according to the first embodiment of the present invention, preferably, the aliphatic dicarboxylate ester includes a compound represented by a general formula, $$R_3(COOR_4)_2,$$

in which $R_3$ is an alkylene group with a carbon number of 3 or greater and 8 or less and $R_4$ is an alkyl group with a carbon number of 2 or greater and 5 or less.

When the aliphatic dicarboxylate ester includes a compound represented by a general formula, $R_3(COOR_4)_2$, in which $R_3$ is an alkylene group with a carbon number of 3 or greater and 8 or less and $R_4$ is an alkyl group with a carbon number of 2 or greater and 5 or less, the dissolution property or swelling property thereof for the resin contained in the toner can be improved. Also, the odor intensity index of the aforementioned compound is 10 or less and the aforementioned compound has no unpleasant odor or no irritating odor.

For the aliphatic dicarboxylate ester which is the aforementioned compound, for example, diethyl succinate, diethyl adipate, diisobutyl adipate, diisopropyl adipate, diisodecyl adipate, diethyl sebacate, dibutyl sebacate, etc., can be provided. Many of these aliphatic dicarboxylate esters which are the aforementioned compound dissolve in the nonaqueous dispersing medium (material B) but do not dissolve in water. Therefore, in regard to many of the aliphatic dicarboxylate esters which are the aforementioned compounds, for example, the fixing liquid according to the first embodiment of the present invention can be obtained by dispersing the aliphatic dicarboxylate ester which is the aforementioned compound in water so as to prepare an aqueous dispersion system and by dispersing the aqueous dispersion system as a particle in a nonaqueous medium. That is, as shown in FIG. 4, a fixing liquid can be obtained in which liquid an aqueous particle is dispersed in the nonaqueous dispersing medium (material B) in which particle the aliphatic dicarboxylate ester as the component (material A) capable of dissolving or swelling at least one portion of the resin contained in the toner is dispersed in water.

In the fixing liquid according to the fist embodiment of the present invention, preferably, the aliphatic ester includes a dialkoxyalkyl aliphatic dicarboxylate.

When the aliphatic ester includes a dialkoxyalkyl aliphatic dicarboxylate, the fixation property of the toner on a recording medium can be improved.

In the fixing liquid according to the first embodiment of the present invention, preferably, the dialkoxyalkyl aliphatic dicarboxylate includes a compound represented by a general formula, $$R_5(COOR_6—O—R_7)_2,$$

in which $R_5$ is an alkylene group with a carbon number of 2 or greater and 8 or less, $R_6$ is an alkylene group with a carbon number of 2 or greater and 4 or less, and $R_7$ is an alkyl group with a carbon number of 1 or greater and 4 or less.

When the dialkoxyalkyl aliphatic dicarboxylate includes a compound represented by a general formula, $R_5(COOR_6—O—R_7)_2$, in which $R_5$ is an alkylene group with a carbon number of 2 or greater and 8 or less, $R_6$ is an alkylene group with a carbon number of 2 or greater and 4 or less, and $R_7$ is an alkyl group with a carbon number of 1 or greater and 4 or less, the dissolution property or swelling property thereof for the resin contained in the toner can be improved. Also, the odor intensity index of the aforementioned compound is 10 or less and the aforementioned compound has no unpleasant odor or no irritating odor.

For the dialkoxyalkyl aliphatic dicarboxylate which is the aforementioned compound, for example, diethoxyethyl succinate, dibutoxyethyl succinate, diethoxyethyl adipate, dibutoxyethyl adipate, diethoxyethyl sebacate, etc., can be provided. Many of these dialkoxyalkyl aliphatic dicarboxylates which are the aforementioned compounds are slightly soluble in water (slightly aqueous). Therefore, in regard to many of the dialkoxyalkyl aliphatic dicarboxylates which are the aforementioned compounds, for example, the fixing liquid according to the first embodiment of the present invention can be obtained by directly dispersing the dialkoxyalkyl aliphatic dicarboxylate which is the aforementioned compound as a particle in a nonaqueous medium. That is, as shown in FIG. 3, a fixing liquid can be obtained in which liquid an aqueous particle is dispersed in the nonaqueous dispersing medium (material B) which particle contains the dialkoxyalkyl aliphatic dicarboxylate as the component (material A) capable of dissolving or swelling at least one portion of the resin contained in the toner.

Additionally, the fixing liquid according to the first embodiment of the present invention can be also obtained by dissolving or dispersing the dialkoxyalkyl aliphatic dicarboxylate which is the aforementioned compound in water so as to prepare an aqueous dispersion system and by dispersing the aqueous dispersion system as a particle in a nonaqueous medium. That is, as shown in FIG. 4, a fixing liquid may be obtained in which liquid an aqueous particle is dispersed in the nonaqueous dispersing medium (material B) in which particle the dialkoxyalkyl aliphatic dicarboxylate as the component (material A) capable of dissolving or swelling at least one portion of the resin contained in the toner is dissolved or dispersed in water.

In the fixing liquid according to the first embodiment of the present invention, preferably, the nonaqueous dispersing medium (material B) includes an n-alkane.

When the nonaqueous dispersing medium (material B) includes an n-alkane, it has a high affinity with, particularly, water-repellently treated toner, and the water-repellently treated toner can be significantly wetted. That is, the n-alkane which is a paraffinic solvent has a low surface tension of 25 mN/m or less and has a high affinity with the water-repellently treated toner.

As a result, when the fixing liquid according to the first embodiment of the present invention is provided to the water-repellently treated toner on the recording medium, the disturbance on an image formed by the water-repellently treated toner can be reduced. For example, the inventors have confirmed that, at least, decane, dodecane, undecane, and tridecane among n-alkanes have low volatilities and when a liquid drop of a fixing liquid containing any of these n-alkanes as the nonaqueous dispersing medium (material B) is provided to a layer of the water-repellently treated toner, the disturbance of the toner layer is seldom caused.

In the fixing liquid according to the first embodiment of the present invention, preferably, the nonaqueous dispersing medium (material B) includes a dimethyl silicone.

When the nonaqueous dispersing medium (material B) includes a dimethyl silicone, it has a high affinity with, particularly, water-repellently treated toner, and the water-repellently treated toner can be significantly wetted. That is, the dimethyl silicone which is a silicone-based solvent has a low surface tension of approximately 20 mN/m and has a high affinity with the water-repellently treated toner.

As a result, when the fixing liquid according to the first embodiment of the present invention is provided to the water-repellently treated toner on the recording medium, the disturbance on an image formed by the water-repellently treated toner can be reduced.

Also, the dimethyl silicone has no odor and a high safety to a human body. Therefore, a fixing liquid containing a dimethyl silicone as the nonaqueous dispersing medium (material B) can be a fixing liquid having a safety to a human body and no odor.

For example, the inventors have confirmed that a dimethyl silicone having a viscosity of 3 mPa·second or greater has a low volatility and when a liquid drop of a fixing liquid containing a dimethyl silicone as the nonaqueous dispersing medium (material B) is provided to a layer of the water-repellently treated toner, the disturbance of the toner layer is seldom caused.

The second embodiment of the present invention is a toner fixing method of fixing a toner containing a resin on a recording medium, wherein the fixing liquid according to the first embodiment of the present invention is used.

In the toner fixing method according to the second embodiment of the present invention, the fixing liquid according to the above-described first embodiment of the present invention is provided to the toner containing a resin on the recording medium so as to fix the toner containing a resin on the recording medium. According to the second embodiment of the present invention, a toner fixing method which can fix a toner on a recording medium more efficiently can be provided as described above.

FIGS. 5A through 5D are diagrams illustrating a specific example of a toner fixing method according to the present invention.

Figure 5A:
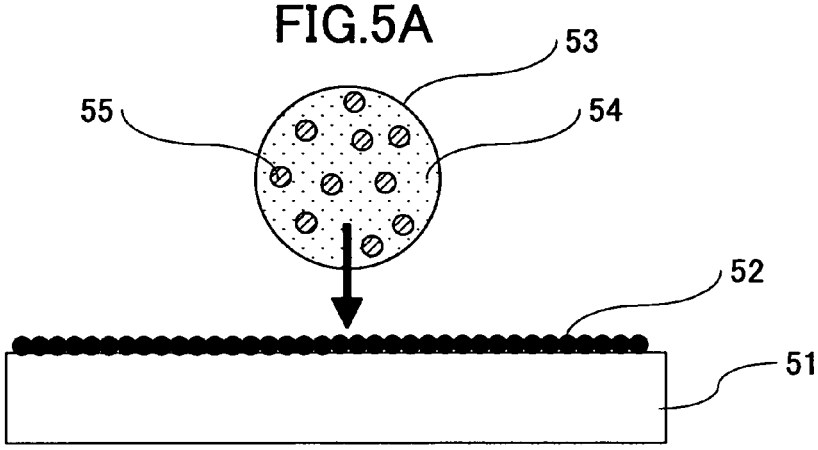
FIGS. 5A, 5B, 5C, and 5D are diagram illustrating a specific example of a toner fixing method according to the present invention.

First, as shown in FIG. 5A, a fixing liquid 53 according to the first embodiment of the present invention is provided to water-repellent toner 52 transcribed on a recording medium 51 using a proper fixing liquid providing device such as an ink jet nozzle and a spray gun. The fixing liquid 53 contains liquid particles 55 which contain a nonaqueous dispersing medium 54 having a high affinity with the water-repellent toner 52 and a component (material A) for dissolving or swelling at least one portion of a resin contained in the toner which component is dispersed in the nonaqueous dispersing medium 54.

Figure 5B:
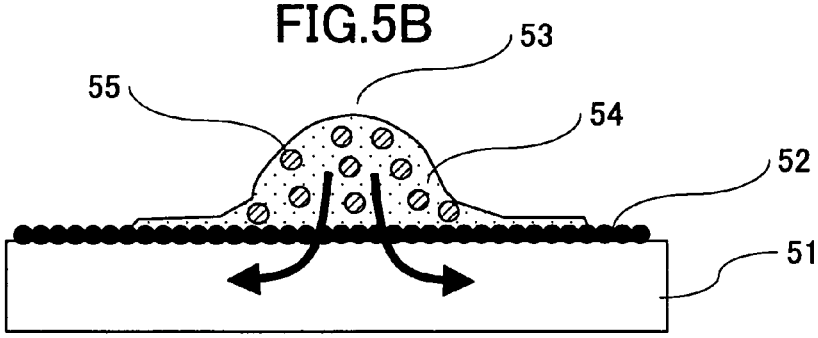

Then, as shown in FIG. 5B, when the fixing liquid 54 contacts the recording medium 51 and the water-repellent toner 52 transcribed on the recording medium 51, the water-repellent toner 52 is not repelled by the fixing liquid 53 and the disturbance of a layer of water-repellent toner 52 transcribed on the recording medium 51 is seldom caused since the fixing liquid 53 mainly contains the nonaqueous dispersing medium (material B) 54 having a high affinity with the water-repellent toner 52. Then, the nonaqueous dispersing medium (material B) 54 and the liquid particles 55 which are contained in the fixing liquid 53 extends on the recording medium 51 and the layer of water-repellent toner 52 transcribed on the recording medium 51.

Figure 5C:
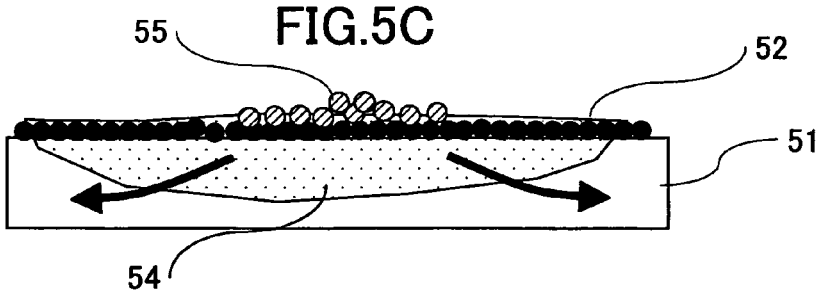

Then, as shown in FIG. 5C, while the nonaqueous dispersing medium (material B) 54 contained in the fixing liquid 53 passes through the space in the water-repellent toner 52 and permeates into the recording medium 51, the liquid particles 55 contained in the fixing liquid 53 do not pass among the space in the layer of water-repellent toner 52 or penetrate through the recording medium 51 but are trapped on the surfaces of the layer of water-repellent toner 52 and recording medium 51. Therefore, when the nonaqueous dispersing medium (material B) 54 passes among the space in the layer of water-repellent toner 52 and permeates into the recording medium 51, the content of the liquid particles 55 contained in the fixing liquid 53, that is, the concentration of the component (material A) for dissolving or swelling at least one portion of a resin contained in the toner increases.

Figure 5D:
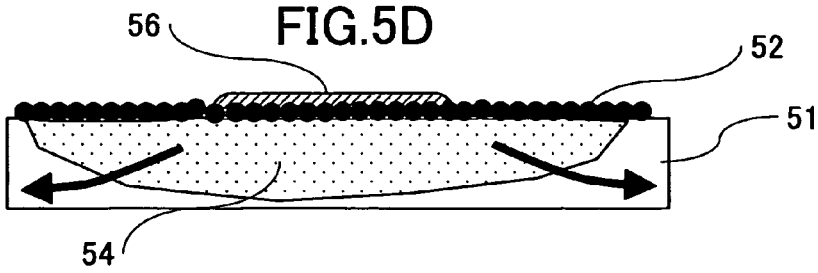

Finally, as shown in FIG. 5D, while the nonaqueous dispersing medium (material B) 54 sufficiently permeates into the recording medium 51, the plural liquid particles 55 combine to each other and form a liquid layer 56 which contains the component (material A) for dissolving or swelling at least one portion of a resin contained in the toner. The component (material A) for dissolving or swelling at least one portion of a resin contained in the toner, which component is contained in the liquid layer 56, rapidly dissolves or swells the water-repellent toner 52. As a result, the layer of water-repellent toner 52 becomes like a film and fixes on the recording medium 51.

Thus, even if the concentration of the component (material A) for dissolving or swelling at least one portion of a resin contained in the toner, in the nonaqueous dispersing medium (material B) 54, is low, the concentration of the component (material A) for dissolving or swelling at least one portion of a resin contained in the toner becomes high on the surface of the toner layer while the nonaqueous dispersing medium (material B) permeates into the recording medium. Therefore, the content of the component (material A) for dissolving or swelling at least one portion of a resin contained in the toner, in the fixing liquid, can be reduced. Also, the content of the component (material A) for dissolving or swelling at least one portion of a resin contained in the toner does not permeate into the recording medium. Accordingly, the component (material A) for dissolving or swelling at least one portion of a resin contained in the toner is not wastefully consumed. Further, since the component (material A) for dissolving or swelling at least one portion of a resin contained in the toner contacts the toner layer at a high concentration, the fixation responsibility of the toner to the recording medium can be increased compared to a fixing liquid in which the component (material A) for dissolving or swelling at least one portion of a resin contained in the toner is dissolved in a nonaqueous solvent.

The third embodiment of the present invention is a toner fixing method of fixing a toner containing a resin on a recording medium, wherein a fixing liquid containing a component (material A) capable of dissolving or swelling at least one portion of the resin contained in the toner is used in which liquid a particle having a particle diameter such that the particle does not penetrate through the recording medium is dispersed in a nonaqueous dispersing medium (material B).

According to the third embodiment of the present invention, a toner fixing method which can fix a toner on a recording medium more efficiently can be provided as described above.

In the toner fixing method according to the third embodiment of the present invention, the fixing liquid is provided to the toner containing a resin on the recording medium so as to fix the toner containing a resin on the recording medium in which liquid a particle is dispersed in the nonaqueous dispersing medium (material B) which particle contains the component (material A) capable of dissolving or swelling at least one portion of the resin contained in the toner and has a particle diameter such that the particle does not penetrate through a recording medium.

Herein, the structures and effects of the toner containing a resin, the recording medium, the component (material A) capable of dissolving or swelling at least one portion of the resin contained in the toner, the particle, the nonaqueous dispersing medium (material B), the dispersion, etc., are similar to those described above, except the particle diameter of the particle containing the component (material A) capable of dissolving or swelling at least one portion of the resin contained in the toner.

In the toner fixing method according to the third embodiment of the present invention, the particle containing the component (material A) capable of dissolving or swelling at least one portion of the resin contained in the toner has a particle diameter such that the particle does not penetrate through the recording medium.

Herein, the particle diameter of the particle containing the component (material A) capable of dissolving or swelling at least one portion of the resin contained in the toner is a volume average particle diameter thereof. The volume average particle diameter of the particle containing the component (material A) capable of dissolving or swelling at least one portion of the resin contained in the toner can be measured by, for example, laser light diffraction and scattering method (For example, the measurement at a wavelength of 780 nm and temperature at 25° C. in an apparatus of Microtrac Inc.).

The particle containing the particle containing the component (material A) capable of dissolving or swelling at least one portion of the resin contained in the toner, having a particle diameter such that the particle does not penetrate through a recording medium, means that, the particle containing the particle containing the component (material A) capable of dissolving or swelling at least one portion of the resin contained in the toner, has a particle diameter such that the particle does not pass through the space in the recording medium, that is, a particle larger than the size of the space in the recording medium. For example, when the recording medium is paper and if a model is considered such that the fiber of the paper is regarded as a capillary, the caliber of the capillary that corresponds to the size of the space in the recording medium is approximately 2 μm for a woodfree paper or approximately 0.1 μm for a coated paper. Therefore, when the recording medium is a woodfree paper, it is preferable that the particle diameter of the particle containing the component (material A) capable of dissolving or swelling at least one portion of the resin contained in the toner is greater than approximately 2 μm. Also, when the recording medium is a coated paper, it is preferable that the particle diameter of the particle containing the component (material A) capable of dissolving or swelling at least one portion of the resin contained in the toner is greater than approximately 0.1 μm.

When the particle containing component (material A) capable of dissolving or swelling at least one portion of the resin contained in the toner has a particle diameter such that the particle does not penetrate through a recording medium and the fixing liquid is provided on a recording medium on which the toner is provided, the particle containing the component (material A) capable of dissolving or swelling at least one portion of the resin contained in the toner can be trapped on the surface of the recording medium on which toner is provided, while the nonaqueous dispersing medium (material B) permeates into the recording medium or penetrates through the recording medium. As a result, the component (material A) capable of dissolving or swelling at least one portion of the resin contained in the toner can be acted on the toner provided on the recording medium more sufficiently. That is, the component (material A) capable of dissolving or swelling at least one portion of the resin contained in the toner can be effectively acted on the toner provided on the recording medium. Accordingly, the toner provided on the recording medium can be fixed more speedily and, as a result, the fixation responsibility of the toner provided on the recording medium can be improved. Also, the quantity of the component (material A) capable of dissolving or swelling at least one portion of the resin contained in the toner can be reduced. Further, the waste with respect to the consumption of the component (material A) capable of dissolving or swelling at least one portion of the resin contained in the toner can be reduced.

In the toner fixing method according to the third embodiment of the present invention, preferably, the particle has a particle diameter equal to or less than an average particle diameter of the toner.

That is, the particle containing the component (material A) capable of dissolving or swelling at least one portion of the resin contained in the toner has a particle diameter equal to or less than an average particle diameter of the toner. Herein, the average particle diameter of the toner is the volume average particle diameter thereof and can be obtained, for example, by irradiating a plurality of toner particles on the recording medium with laser and from the wavelength of the laser light and the average value of diffraction angle of laser light diffracted by the toner particles.

When the particle containing the component (material A) capable of dissolving or swelling at least one portion of the resin contained in the toner has a particle diameter equal to or less than an average particle diameter of the toner and the fixing liquid is provided to a recording medium on which toner is provided, it can be reduced to excessively dissolve or swell the toner provided on the recording medium and it can be reduced for liquefied toner to permeate into the recording medium and to cause the disturbance of an image (bleeding) formed by the toner provided on the recording medium. That is, the image formed by the toner can be fixed on the recording medium well. Also, the component (material A) capable of dissolving or swelling at least one portion of the resin contained in the toner can be uniformly provided to the toner provided on the recording medium.

Further, the particle diameter (volume average particle diameter) of the particle containing the component (material A) capable of dissolving or swelling at least one portion of the resin contained in the toner is preferably greater than the size of the space among particles of the toner provided on the recording medium.

Figure 6A:
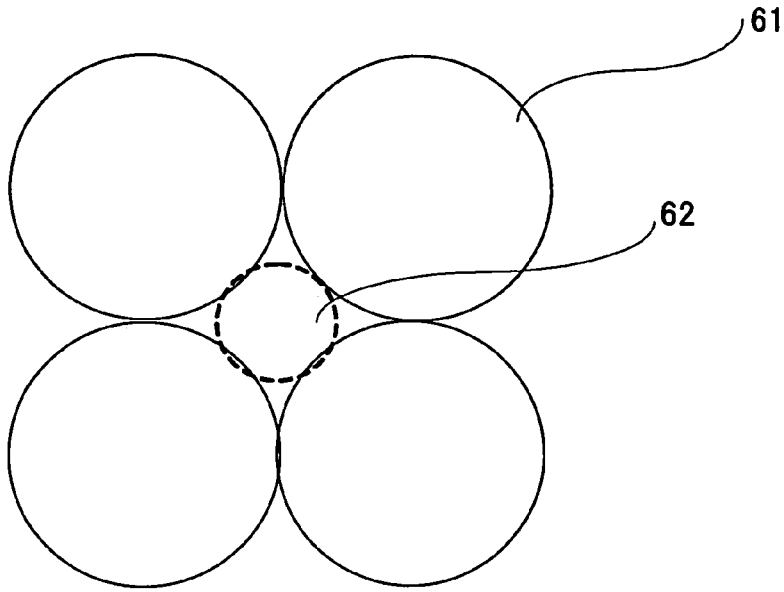
FIGS. 6A and 6B are diagrams illustrating the size of space among toner particles provided on a recording medium.
Figure 6B:
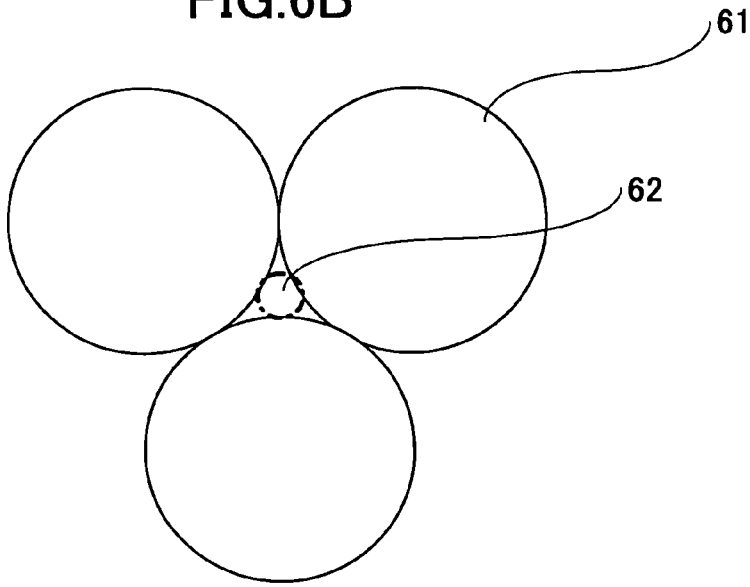

FIGS. 6A and 6B are diagrams illustrating the sizes of the space among particles of toner provided on a recording medium. FIG. 6A is a diagram illustrating the size of the space among the toner particles arranging in a plane in a body-centered cubic structure and FIG. 6B is a diagram illustrating the size of the space among the toner particles arranging in a plane in a cubic closest packed structure.

The size of the space among particles of the toner provided on the recording medium depends on the arrangement of the particles of the toner provided on the recording medium. Herein, it is assumed that the particles of the toner are spherical. As shown in FIG. 6A, where toner particles 61 are arranged in a plane of the body-centered cubic structure, the diameter of a minimum inscribed circle 62 for four toner particles 61 in a space surrounded by the four toner particles 61 is equal to $((\sqrt{2})-1)\times$(diameter of toner particle). Also, as shown in FIG. 6B, where toner particles 61 are arranged in a plane in the cubic closest packed structure, the diameter of a minimum inscribed circle 62 for three toner particles 61 in a space surrounded by the three toner particles 61 is equal to $(2/(\sqrt{3})-1)\times$(diameter of toner particle). For the size of the space among particles of the toner provided on the recording medium, these diameters of a minimum inscribed circle for toner particles in the space among them can be used.

For example, it is assumed that the diameter of a toner particle is 5 μm through 10 μm. In this case, as shown in FIG. 6A, when the toner particles 61 are arranged in a plane in the body-centered cubic structure, the diameter of a minimum inscribed circle 62 for four toner particles 61 in a space surrounded by the four toner particles 61, as a size of the space among particles of the toner provided on the recording medium, is approximately 2 μm through 4 μm. As shown in FIG. 6B, when toner particles 61 are arranged in a plane in the cubic closest packed structure, the diameter of a minimum inscribed circle 62 for three toner particles 61 in a space surrounded by the three toner particles 61, as a size of the space among particles of the toner provided on the recording medium, is approximately 0.3 μm through 0.7 μm.

When the particle containing the component (material A) capable of dissolving or swelling at least one portion of the resin contained in the toner has a particle diameter greater than the size of the space among the toner particles and the fixing liquid is provided to the toner provided on the recording medium, the particle containing the component (material A) capable of dissolving or swelling at least one portion of the resin contained in the toner can be trapped on the toner provided on the recording medium, while the nonaqueous dispersing medium (material B) passes through the space among the toner particles and permeates into the recording medium or penetrates through the recording medium. As a result, the component (material A) capable of dissolving or swelling at least one portion of the resin contained in the toner can be acted on the toner provided on the recording medium more sufficiently. That is, the component (material A) capable of dissolving or swelling at least one portion of the resin contained in the toner can be effectively acted on the toner provided on the recording medium. Accordingly, the toner provided on the recording medium can be fixed more speedily and, as a result, the fixation responsibility of the toner provided on the recording medium can be improved. Also, the quantity of the component (material A) capable of dissolving or swelling at least one portion of the resin contained in the toner can be reduced. Further, the waste with respect to the consumption of the component (material A) capable of dissolving or swelling at least one portion of the resin contained in the toner can be reduced.

The four embodiment of the present invention is a toner fixing apparatus configured to fix a toner containing a resin on a recording medium, wherein the toner fixing method according to the second or third embodiment according to the present invention is used.

According to the fourth embodiment of the present invention, a toner fixing apparatus can be provided which can fix a toner on a recording medium more efficiently, as described above.

A toner fixing apparatus according to the fourth embodiment of the present invention includes, for example, a fixing liquid container for storing the fixing liquid according to the first embodiment of the present invention, which liquid is used in the toner fixing method according to the second or third embodiment of the present invention, and a proper fixing liquid providing device for providing the fixing liquid to unfixed toner provided on a recording medium, such as a liquid drop flight device, which may include a spray gun or an ink jet nozzle. Also, the toner fixing apparatus may include a pair of smoothing rollers (hard rollers) for pressurizing toner dissolved or swelled by the component (material A) capable of dissolving or swelling at least one portion of the resin contained in the toner, after the fixing liquid according to the first embodiment of the present invention is provided to the toner. As the dissolved or swelled toner is pressurized by a pair of the smoothing rollers (hard rollers), the surface of a layer of the dissolved or swelled toner can be smoothed so as to provide the toner with the luster thereof. Also, the fixation property of the toner on the recording medium can be improved by forcing the dissolved or swelled toner to the recording medium.

Figure 7:
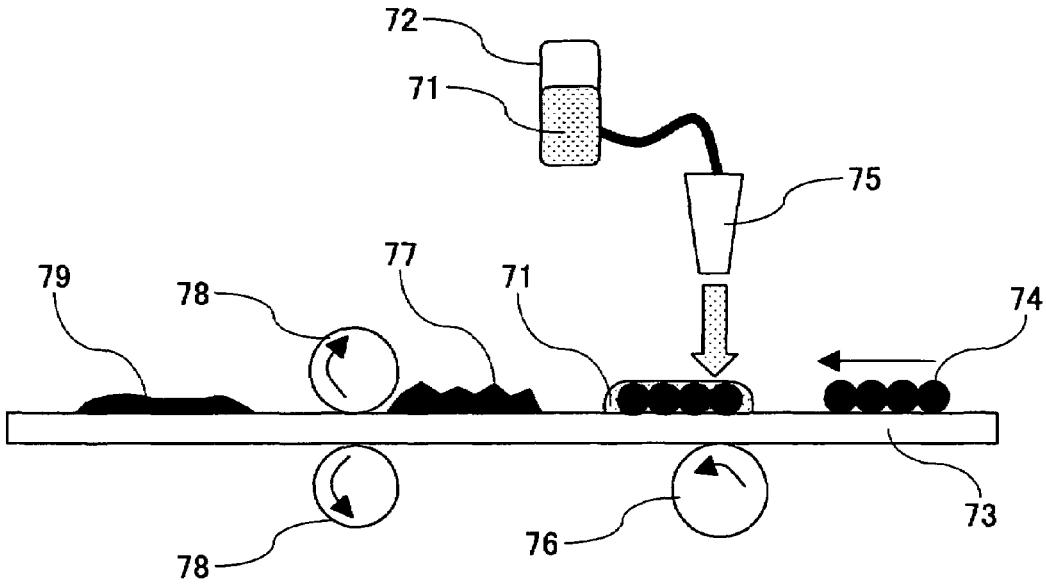
FIG. 7 is a diagram illustrating a specific example of a toner fixing apparatus according to the present invention.

FIG. 7 is a diagram illustrating a specific example of a toner fixing apparatus according to the present invention. The toner fixing apparatus shown in FIG. 7 includes a fixing liquid container 72 for storing fixing liquid 71, a fixing liquid providing device 75 for providing the fixing liquid 71 to toner 74 transcribed on a recording medium 73, such as a spray gun, a conveyance roller 76 for conveying the recording medium 73 on which the toner 74 is provided, and a pair of smoothing rollers 78 for pressurizing toner 77 dissolved or swelled by the fixing liquid 71.

In the toner fixing apparatus shown in FIG. 7, the recording medium 73 on which the toner 74 is provided is conveyed by the conveyance roller 76 and the fixing liquid 71 stored in the fixing liquid container 72 is provided to the toner 74 on the recording medium 73 by the fixing liquid providing device 75. As the fixing liquid 71 is provided to the toner 74 on the recording medium 73, the toner is dissolved or swelled by a component (material A) capable of dissolving or swelling at least one portion of the resin contained in the toner, which component is contained in the fixing liquid 71. The toner 77 dissolved or swelled by the fixing liquid 71 is further conveyed with the recording medium 73 by the conveyance roller 76. Then, the toner 77 dissolved or swelled by the fixing liquid 71 is pressurized by a pair of the smoothing rollers 78 and fixed as fixed toner 79 on the recording medium 73.

The fifth embodiment of the present invention is an image forming method of forming an image of toner containing a resin on a recording medium, wherein the toner fixing method according to the second or third embodiment of the present invention is used.

The sixth embodiment of the present invention is an image forming apparatus configured to form an image of toner containing a resin on a recording medium, wherein the image forming method according to the fifth embodiment of the preset invention is used.

According to the image forming method according to the fifth embodiment of the present invention and the image forming apparatus according to the sixth embodiment of the present invention, an image forming method and an image forming apparatus can be provided, respectively, which can fix a toner on a recording medium more efficiently, as described above.

Figure 8A:
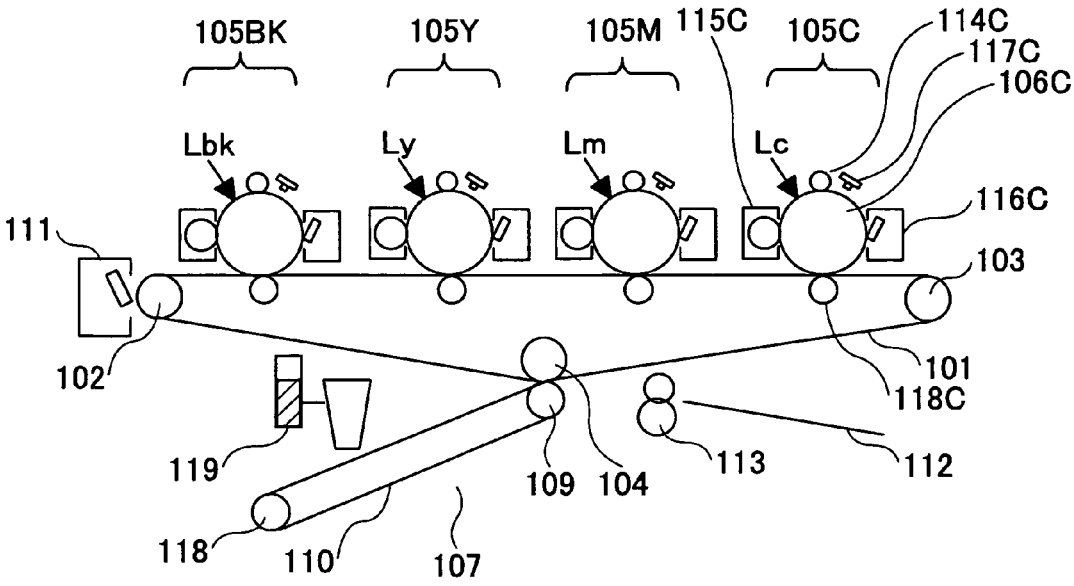
FIGS. 8A and 8B are diagrams illustrating specific examples of an image forming method and image forming apparatus according to the present invention.
Figure 8B:
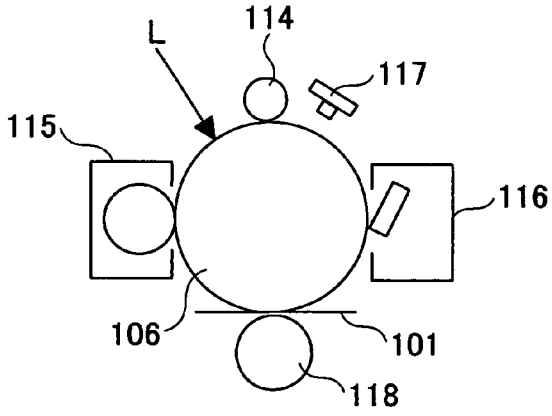

FIGS. 8A and 8B are diagrams illustrating specific examples of the image forming method and image forming apparatus according to the present invention. FIG. 8A is a diagram illustrating an color-electrophotographic tandem-type image forming apparatus, which may be a copying machine or a printer, and FIG. 8B illustrates one of image forming units of the image forming apparatus shown in FIG. 8A.

The image forming apparatus shown in FIGS. 8A and 8B includes an intermediary transcription belt 101 as a toner image carrier. The intermediary transcription belt 101 is tensioned and extends on three supporting rollers 102, 103 and 104, and rotates clockwise. Respective image forming units 105K, 105Y, 105M and 105C for black, yellow, magenta and cyan are arranged for the intermediary transcription belt 101. Above these image forming units, light-exposure devices which are not shown in the figure are arranged. For example, when the image forming apparatus is a copying machine, image information for an original copy is read using a scanner and light L is emitted from the light-exposure device in order to write an electrostatic latent image on each photoconductor drum 106 depending on the image information.

A secondary transcription device 107 is provided at a location such that it opposes the supporting roller 104 for the intermediary transcription belt 101. The secondary transcription device 107 includes a secondary transcription belt 110 which is tensioned and extends on two supporting rollers 108 and 109. However, a transcription roller as well as the transcription belt may be used for the secondary transcription device 107. Also, a belt cleaning device 111 is arranged at a location such that it opposes the supporting roller 102 through the intermediary transcription belt 101. The belt cleaning device 111 is arranged to eliminate toner remaining on the intermediary transcription belt 101.

A recording paper 112 as a recording medium is guided to a secondary transcription part by a pair of paper feeding rollers 113, and a toner image is transcribed by forcing the secondary transcription belt 110 on the intermediary transcription belt 101 when the toner image is transcribed on the recording paper 112.

The recording paper 112 on which the toner image is transcribed is conveyed by the secondary transcription belt 110 and the unfixed toner image transcribed on the recording paper 112 is fixed using a toner fixing apparatus 119 according to the fourth embodiment of the present invention. That is, a fixing liquid according to the first embodiment of the present invention supplied from the toner fixing apparatus 119 is provided to the unfixed toner image transcribed on the recording paper 112, and the unfixed toner image is fixed on the recording paper 112 by a component (material A) capable of dissolving or swelling at least one portion of the resin contained in the toner, which component is contained in the fixing liquid.

Next, an image forming unit is described. As shown in FIG. 8B, a charging device 114, a developing device 115, a cleaning device 116 and a charge eliminating device 117 are arranged around the photoconductor drum 106 for the image forming unit. Also, a primary transcription device 118 is arranged so that it opposes the photoconductor drum 106 through the intermediary transcription belt 101.

The charging device 114 is a charging device according to a contact charging method which uses a charging roller. The charging device 114 uniformly charges the surface of the photoconductor drum 106 by contacting the charging roller with the photoconductor drum 106 and applying a voltage to the photoconductor drum 106. For the charging device 114, a charging device according to a non-contact charging method which uses a non-contact scorotron, etc., can be also used.

The developing device 115 makes toner in developer adhere to an electrostatic latent image on the photoconductor drum 106 so that the electrostatic latent image is visualized. Herein, toner corresponding to each color is composed of a resin material colored with each color and the resin material can be dissolved or swelled by the fixing liquid according to the first embodiment of the present invention. Additionally, the developing device 115 includes an agitation part and developing part which are not shown in the figure and developer which has not been used for development returns to the agitation part and is recycled. The concentration of the toner in the agitation part is detected by a toner concentration sensor and the agitation part is controlled so that the concentration of the toner is constant.

The primary transcription device 118 transcribes the toner visualized on the photoconductor drum 106 to the intermediary transcription belt 101. Herein, for the primary transcription device 118, a transcription roller is employed and the transcription roller is forced on the photoconductor drum 106 through the intermediary transcription belt 101. For the primary transcription device 118, an electrically conductive brush, a non-contact corona charger, etc., can be also used.

The cleaning device 116 eliminates unwanted toner on the photoconductor drum 106. For the cleaning device 116, a blade with an end which is forced on the photoconductor drum 106 can be used. Herein, the toner collected by the cleaning device 116 is collected into and recycled in the developing device 115 by a collecting screw and toner recycle device which are not shown in the figure.

The charge eliminating device 117 is composed of a lamp and initialize the surface electric potential of the photoconductor drum 106 by light irradiation.

Next, the embodiments of the present invention are described using practical examples. Herein, liquid for softening toner in the practical examples and comparative examples means liquid for dissolving or swelling at least one portion of a resin contained in toner.

PRACTICAL EXAMPLE 1

A mixture of 10% by weight of diethoxyethyl succinate ($LD_{50}$=5 g/kg) as liquid for softening toner, 89% by weight of dimethylsiloxane (viscosity: 10 mPa·s, $LD_{50}$=15 g/kg) as a nonaqueous dispersing medium (material B), and 1% by weight of a dispersing agent for W/O emulsion (Span 80: HLB value=4.3) was stirred using a homomixer, so that a fixing liquid was prepared in which particles of diethoxyethyl succinate with an average particle diameter of 5 μm were dispersed in dimethylsiloxane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, the toner did not adhere to the waste even after 5 seconds and the toner had fixed on the PPC paper. Also, the odor intensity index of diethoxyethyl succinate was 1, the odor intensity index of dimethylsiloxane was 0, and the odor intensity of the fixing liquid was 0. Additionally, no unpleasant odor generated in a laboratory at the time of fixation of the toner image. Further, as an image portion of the fixed toner was observed using an optical microscope, there was no disturbance on a layer of the fixed toner and a good layer of the fixed toner was observed on the PPC paper.

COMPARATIVE EXAMPLE 1

A mixture of 10% by weight of diisobutyl adipate ($LD_{50}$=12.3 g/kg) as liquid for softening toner and 90% by weight of dimethylsiloxane (viscosity: 10 mPa·s, $LD_{50}$=15 g/kg) as a nonaqueous solvent was stirred using a stirrer, so that a fixing liquid was prepared in which diisobutyl adipate was dissolved in dimethylsiloxane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, although no disturbance of the toner image was observed, when an image portion was rubbed with the waste even after 20 seconds, the toner adhered to the waste and the toner did not adhere to the PPC paper. After a lapse of 10 minutes from the situation, as the rubbing with the waste was made again, the toner did not adhere to the waste eventually and the toner had fixed on the PPC paper.

COMPARISON EXAMPLE 2

A mixture of 7% by weight of diethoxyethyl succinate ($LD_{50}$=5 g/kg) as liquid for softening toner, 92% by weight of water, and 1% by weight of a nonionic surface active agent was stirred using a stirrer, so that a fixing liquid was prepared in which diethoxyethyl succinate was dissolved in water.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, water evaporated after 5 seconds and the concentration of the liquid for softening toner in the fixing liquid increased. Then, the toner did not adhere to the waste and the toner had fixed on the PPC paper. However, as an image portion of the fixed toner was observed using an optical microscope, noticeable blank and some image disturbance were observed in parts of a layer of the fixed toner.

PRACTICAL EXAMPLE 2

A mixture of 10% by weight of diethoxyethyl succinate ($LD_{50}$=5 g/kg) as liquid for softening toner, 89% by weight of n-dodecane (viscosity: 1 mPa·s, $LD_{50}$>5 g/kg) as a nonaqueous dispersing medium (material B), and 1% by weight of a dispersing agent for W/O emulsion (Span 80: HLB value=4.3) was stirred using a homomixer, so that a fixing liquid was prepared in which particles of diethoxyethyl succinate with an average particle diameter of 2 μm were dispersed in n-dodecane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, the toner did not adhere to the waste even after 5 seconds and the toner had fixed on the PPC paper. Also, the odor intensity index of diethoxyethyl succinate was 1, the odor intensity index of n-dodecane was 0, and the odor intensity of the fixing liquid was 0. Additionally, no unpleasant odor generated in a laboratory at the time of fixation of the toner image. Further, as an image portion of the fixed toner was observed using an optical microscope, there was no disturbance on a layer of the fixed toner and a good layer of the fixed toner was observed on the PPC paper.

COMPARATIVE EXAMPLE 3

A mixture of 10% by weight of diisobutyl adipate ($LD_{50}$=12.3 g/kg) as liquid for softening toner and 90% by weight of n-dodecane (viscosity: 1 mPa·s, $LD_{50}$>5 g/kg) as a nonaqueous solvent was stirred using a stirrer, so that a fixing liquid was prepared in which diisobutyl adipate was dissolved in n-dodecane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, although no disturbance of the toner image was observed, when an image portion was rubbed with the waste even after 20 seconds, the toner adhered to the waste and the toner did not adhere to the PPC paper. After a lapse of 5 minutes from the situation, as the rubbing with the waste was made again, the toner did not adhere to the waste eventually and the toner had fixed on the PPC paper.

PRACTICAL EXAMPLE 3

A mixture of 30% by weight of ethyl laurate ($LD_{50}$=3 g/kg) as liquid for softening toner, 69% by weight of water, and 1% by weight of a nonionic surface active agent was stirred using a homogenizer, so that an O/W type emulsion liquid was prepared in which ethyl laurate was dispersed in water. Then, a mixture of 20% by weight of the O/W type emulsion liquid, 79% by weight of a dimethyl silicone oil (viscosity: 10 mPa·s, $LD_{50}$=15 g/kg) as a nonaqueous dispersing medium (material B), and 1% by weight of a dispersing agent for W/o emulsion (Span 80: HLB value=4.3) was stirred using a homomixer, so that a fixing liquid (O/W/O type emulsion liquid) was prepared in which particles of the O/W type emulsion liquid with an average particle diameter of 5 μm were dispersed in the dimethyl silicone oil.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, the toner did not adhere to the waste even after 5 seconds and the toner had fixed on the PPC paper. Also, although the odor intensity index of ethyl laurate was 13, the odor intensity index of the dimethyl silicone oil was 0 and the odor intensity of the fixing liquid was 10. Additionally, no unpleasant odor generated in a laboratory at the time of fixation of the toner image. Further, as an image portion of the fixed toner was observed using an optical microscope, there was no disturbance on a layer of the fixed toner and a good layer of the fixed toner was observed on the PPC paper.

COMPARATIVE EXAMPLE 4

A mixture of 10% by weight of ethyl laurate ($LD_{50}$=3 g/kg) as liquid for softening toner and 90% by weight of dimethylsiloxane (viscosity: 10 mPa·s, $LD_{50}$=15 g/kg) as a nonaqueous solvent was stirred using a stirrer, so that a fixing liquid was prepared in which ethyl laurate was dissolved in dimethylsiloxane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, although no disturbance of the toner image was observed, when an image portion was rubbed with the waste even after 20 seconds, the toner adhered to the waste and the toner did not adhere to the PPC paper. After a lapse of 5 minutes from the situation, as the rubbing with the waste was made again, the toner did not adhere to the waste eventually and the toner had fixed on the PPC paper.

PRACTICAL EXAMPLE 4

A mixture of 30% by weight of dibutyl sebacate ($LD_{50}$=14.9 g/kg) as liquid for softening toner, 69% by weight of water, and 1% by weight of a nonionic surface active agent was stirred using a homogenizer, so that an O/W type emulsion liquid was prepared in which dibutyl sebacate was dispersed in water. Then, a mixture of 20% by weight of the O/W type emulsion liquid, 79% by weight of n-dodecane (viscosity: 1 mPa·s, $LD_{50}$>5 g/kg) as a nonaqueous dispersing medium (material B), and 1% by weight of a dispersing agent for W/O emulsion (Span 80: HLB value=4.3) was stirred using a homomixer, so that a fixing liquid (O/W/O type emulsion liquid) was prepared in which particles of the O/W type emulsion liquid with an average particle diameter of 2 μm were dispersed in n-dodecane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, the toner did not adhere to the waste even after 5 seconds and the toner had fixed on the PPC paper. Also, although the odor intensity index of dibutyl sebacate was 13, the odor intensity index of n-dodecane was 0 and the odor intensity of the fixing liquid was 10. Additionally, no unpleasant odor generated in a laboratory at the time of fixation of the toner image. Further, as an image portion of the fixed toner was observed using an optical microscope, there was no disturbance on a layer of the fixed toner and a good layer of the fixed toner was observed on the PPC paper.

PRACTICAL EXAMPLE 5

A mixture of 30% by weight of diisobutyl adipate ($LD_{50}$=12.3 g/kg) as liquid for softening toner, 69% by weight of water, and 1% by weight of a nonionic surface active agent was stirred using a homogenizer, so that an O/W type emulsion liquid was prepared in which diisobutyl adipate was dispersed in water. Then, a mixture of 20% by weight of the O/W type emulsion liquid, 79% by weight of n-undecane (viscosity: 1 mPa·s, $LD_{50}$>5 g/kg) as a nonaqueous dispersing medium (material B), and 1% by weight of a dispersing agent for W/O emulsion (Span 80: HLB value=4.3) was stirred using a homomixer, so that a fixing liquid (O/W/O type emulsion liquid) was prepared in which particles of the O/W type emulsion liquid with an average particle diameter of 5 μm were dispersed in n-undecane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, the toner did not adhere to the waste even after 5 seconds and the toner had fixed on the PPC paper. Also, although the odor intensity index of diisobutyl adipate was 13, the odor intensity index of n-undecane was 0 and the odor intensity of the fixing liquid was 10. Additionally, no unpleasant odor generated in a laboratory at the time of fixation of the toner image. Further, as an image portion of the fixed toner was observed using an optical microscope, there was no disturbance on a layer of the fixed toner and a good layer of the fixed toner was observed on the PPC paper.

PRACTICAL EXAMPLE 6

A mixture of 10% by weight of diethoxyethyl sebacate ($LD_{50}$>5 g/kg) as liquid for softening toner, 89% by weight of dimethylsiloxane (viscosity: 10 mPa·s, $LD_{50}$=15 g/kg) as a nonaqueous dispersing medium (material B), and 1% by weight of a dispersing agent for W/O emulsion (Span 80: HLB value=4.3) was stirred using a homomixer, so that a fixing liquid was prepared in which particles of diethoxyethyl sebacate with an average particle diameter of 5 μm were dispersed in dimethylsiloxane.

In a fixing apparatus of a printer Ipsio CX6100 (produced by Ricoh Company, Ltd.), the obtained fixing liquid was spray-applied on a PPC paper on which an unfixed toner image was formed, without heating a fixing part of the fixing apparatus. Then, the surface of the image was rubbed with a waste after 5 seconds, 10 seconds, and 20 seconds, and the degree of toner fixation on the PPC paper was evaluated based on the presence or absence of adhesion of the toner to the waste.

As a result, the toner did not adhere to the waste even after 5 seconds and the toner had fixed on the PPC paper. Also, the odor intensity index of diethoxyethyl sebacate was 1, the odor intensity index of dimethylsiloxane was 0, and the odor intensity of the fixing liquid was 0. Additionally, no unpleasant odor generated in a laboratory at the time of fixation of the toner image. Further, as an image portion of the fixed toner was observed using an optical microscope, there was no disturbance on a layer of the fixed toner and a good layer of the fixed toner was observed on the PPC paper.

From the result of comparison between practical example 1 and comparison example 1, the result of comparison between practical example 2 and comparison example 3, and the result of comparison between practical example 3 and comparison example 4, it was confirmed that a fixing liquid in which liquid for softening toner was dispersed in a nonaqueous dispersing medium (material B) indicated a significantly higher fixation responsibility than a fixing liquid in which liquid for softening toner was dissolved in a nonaqueous solvent.

Also, from the result of comparison between practical example 1 and comparison example 2, it was confirmed that a fixing liquid in which liquid for softening toner was dispersed in a nonaqueous dispersing medium (material B) could provide a layer of fixed toner with no disturbance and a good layer of fixed toner, compared to a fixing liquid in which liquid for softening toner was dispersed in water.

Further, from the result of comparison between practical examples 4, 5, and 6 and practical examples 1, 2, and 3, it was confirmed that a fixing liquid in which an aqueous dispersion system obtained by dispersing liquid for softening toner in water was dispersed as particles in a nonaqueous dispersing medium (material B) indicated a significant fixation responsibility similarly to a fixing liquid in which liquid for softening toner was directly dispersed in a nonaqueous dispersing medium (material B).

Additionally, it was also confirmed that the odor intensity indices of the fixing liquids obtained in practical examples 1 through 6 were 10 or less and no unpleasant odor generated in the laboratory at the time of fixation of a toner image.

[Appendix]

The representative embodiments (1) through (22) of the present invention are provided below.

(1) A fixing liquid configured to fix a toner containing a resin on a recording medium, characterized in that a particle containing a component capable of dissolving or swelling at least one portion of the resin contained in the toner is dispersed in a nonaqueous dispersing medium.

(2) The fixing liquid as described in (1) above, characterized in that the particle is liquid.

(3) The fixing liquid as described in (1) or (2) above, characterized in that the particle consists of a single phase containing the component capable of dissolving or swelling at least one portion of the resin contained in the toner.

(4) The fixing liquid as described in (1) or (2) above, characterized in that the particle contains the component capable of dissolving or swelling at least one portion of the resin contained in the toner and a solvent or dispersing medium which dissolves or disperses the component capable of dissolving or swelling at least one portion of the resin contained in the toner.

(5) The fixing liquid as described in any of (1) through (4) above, characterized in that a volume average particle diameter of the particle is 0.1 μm or greater.

(6) The fixing liquid as described in any of (1) through (5) above, characterized in that a volume average particle diameter of the particle is 6 μm or less.

(7) The fixing liquid as described in any of (1) through (6) above, characterized in that a content of the particle contained in the nonaqueous dispersing medium is 0.5% by weight or greater and 50% by weight or less.

(8) The fixing liquid as described in any of (1) through (7) above, characterized in that the component capable of dissolving or swelling at least one portion of the resin contained in the toner comprises an aliphatic ester.

(9) The fixing liquid as described in (8) above, characterized in that the aliphatic ester comprises a saturated aliphatic ester.

(10) The fixing liquid as described in (9) above, characterized in that the saturated aliphatic ester comprises a compound represented by a general formula, $R_1COOR_2$, in which $R_1$ is an alkyl group with a carbon number of 11 or greater and 14 or less, and $R_2$ is an alkyl group with a carbon number of 1 or greater and 3 or less.

(11) The fixing liquid as described in any of (8) through (10) above, characterized in that the aliphatic ester comprises an aliphatic dicarboxylate ester.

(12) The fixing liquid as described in (11) above, characterized in that the aliphatic dicarboxylate ester comprises a compound represented by a general formula, $R_3(COOR_4)_2$, in which $R_3$ is an alkylene group with a carbon number of 3 or greater and 8 or less, and $R_4$ is an alkyl group with a carbon number of 2 or greater and 5 or less.

(13) The fixing liquid as described in any of (8) through (12) above, characterized in that the aliphatic ester comprises a dialkoxyalkyl aliphatic dicarboxylate.

(14) The fixing liquid as described in (13) above, characterized in that the dialkoxyalkyl aliphatic dicarboxylate comprises a compound represented by a general formula, $R_5(COOR_6—O—R_7)_2$, in which $R_5$ is an alkylene group with a carbon number of 2 or greater and 8 or less, $R_6$ is an alkylene group with a carbon number of 2 or greater and 4 or less, and $R_7$ is an alkyl group with a carbon number of 1 or greater and 4 or less.

(15) The fixing liquid as described in any of (1) through (14) above, characterized in that the nonaqueous dispersing medium comprises an n-alkane.

(16) The fixing liquid as described in any of (1) through (15) above, characterized in that the nonaqueous dispersing medium comprises a dimethyl silicone.

(17) A toner fixing method of fixing a toner containing a resin on a recording medium, characterized in that the fixing liquid as described in any of (1) through (16) above is used.

(18) A toner fixing method of fixing a toner containing a resin on a recording medium, characterized in that a fixing liquid containing a component capable of dissolving or swelling at least one portion of the resin contained in the toner is used in which liquid a particle having a particle diameter such that the particle does not penetrate through the recording medium is dispersed in a nonaqueous dispersing medium.

(19) The toner fixing method as described in (18) above, characterized in that the particle has a particle diameter equal to or less than an average particle diameter of the toner.

(20) A toner fixing apparatus configured to fix a toner containing a resin on a recording medium, characterized in that the toner fixing method as described in any of (17) through (19) above is used.

(21) An image forming method of forming an image of toner containing a resin on a recording medium, characterized in that the toner fixing method as described in any of (17) through (19) above is used.

(22) An image forming apparatus configured to form an image of toner containing a resin on a recording medium, characterized in that the image forming method as described in (21) above is used.

According to the embodiments of the present invention, a fixing liquid, a toner fixing method, a toner fixing apparatus, an image forming method, and an image forming apparatus can be provided which can fix a toner on a recording medium more efficiently.

The embodiments and examples of the present invention have been specifically described above, but the present invention is not limited to these embodiments and examples and these embodiments and examples of the present invention can be varied or modified without departing from the spirit and scope of the present invention.

The present application claims benefits of the priority based on Japanese Patent Application No. 2005-148829 filed on May 20, 2005, the entire contents of which are hereby incorporated by reference.

What is claimed is:

1. A fixing liquid configured to fix a toner containing a resin on a recording medium, wherein a particle containing a component capable of dissolving or swelling at least one portion of the resin contained in the toner is dispersed in a nonaqueous dispersing medium, wherein said component capable of dissolving or swelling at least one portion of the resin contained in the toner comprises an aliphatic ester, and wherein the aliphatic ester comprises a dialkoxyalkyl aliphatic dicarboxylate.

2. The fixing liquid as claimed in claim 1, wherein the particle is liquid.

3. The fixing liquid as claimed in claim 1, wherein the particle consists of a single phase containing the component capable of dissolving or swelling at least one portion of the resin contained in the toner.

4. The fixing liquid as claimed in claim 1, wherein the particle contains the component capable of dissolving or swelling at least one portion of the resin contained in the toner and a solvent or dispersing medium which dissolves or disperses the component capable of dissolving or swelling at least one portion of the resin contained in the toner.

5. The fixing liquid as claimed in claim 1, wherein a volume average particle diameter of the particle is 0.1μm or greater and 6μm or less.

6. The fixing liquid as claimed in claim 1, wherein a content of the particle contained in the nonaqueous dispersing medium is 0.5% by weight or greater and 50% by weight or less.

7. The fixing liquid as claimed in claim 1, wherein the dialkoxyalkyl aliphatic dicarboxylate comprises a compound represented by a general formula, $$R_5(COOR_6—O—R_7)_2,$$

in which $R_5$ is an alkylene group with a carbon number of 2 or greater and 8 or less, $R_6$ is an alkylene group with a carbon number of 2 or greater and 4 or less, and $R_7$ is an alkyl group with a carbon number of 1 or greater and 4 or less.

8. The fixing liquid as claimed in claim 1, wherein the nonaqueous dispersing medium comprises an n-alkane.

9. The fixing liquid as claimed in claim 1, wherein the nonaqueous dispersing medium comprises a dimethyl silicone.

10. A toner fixing method of fixing a toner containing a resin on a recording medium, wherein the fixing liquid as claimed in claim 1 is used.

11. A toner fixing method of fixing a toner containing a resin on a recording medium, wherein a fixing liquid containing a component capable of dissolving or swelling at least one portion of the resin contained in the toner is used in which liquid a particle having a particle diameter such that the particle does not penetrate through the recording medium is dispersed in a nonaqueous dispersing medium.

12. The toner fixing method as claimed in claim 11, wherein the particle has a particle diameter equal to or less than an average particle diameter of the toner.

13. A toner fixing apparatus configured to fix a toner containing a resin on a recording medium, wherein the toner fixing method as claimed in claim 10 is used.

14. A toner fixing apparatus configured to fix a toner containing a resin on a recording medium, wherein the toner fixing method as claimed in claim 11 is used.

* * * * *